US011762316B2

(12) United States Patent
Nishi

(10) Patent No.: US 11,762,316 B2
(45) Date of Patent: Sep. 19, 2023

(54) IMAGE FORMING APPARATUS, IMAGE FORMING SYSTEM, AND NON-TRANSITORY RECORDING MEDIUM STORING COMPUTER READABLE CONTROL PROGRAM

(71) Applicant: Konica Minolta, Inc., Tokyo (JP)

(72) Inventor: Youichirou Nishi, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/714,568

(22) Filed: Apr. 6, 2022

(65) Prior Publication Data

US 2022/0334520 A1 Oct. 20, 2022

(30) Foreign Application Priority Data

Apr. 16, 2021 (JP) ..... 2021-069591

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
See application file for complete search history.

(56) References Cited

U.S. PATENT DOCUMENTS

2013/0258421 A1* 10/2013 Nakaie ..... G03G 15/04036 358/474

FOREIGN PATENT DOCUMENTS

JP H08106189 A * 4/1996
JP 2008-158076 A 7/2008
JP 2019202424 A * 11/2019 ..... G03G 15/5062

OTHER PUBLICATIONS

JP_2019202424_A_I MachineTranslation, Japan, 2019, Yamamoto et al.*
JP_H08106189_A_I MachineTranslation, 1996, Matsuo.*

* cited by examiner

*Primary Examiner* — Victor Verbitsky
(74) *Attorney, Agent, or Firm* — Rankin, Hill & Clark LLP

(57) ABSTRACT

An image forming apparatus includes: a transferer that transfers a toner image on an image carrier formed by an image former onto a paper sheet; a fixer that heats and thereby fixes the toner image on the paper sheet; a read image acquisitor that acquires read image data of the paper sheet on a downstream side of the fixer in a conveyance direction, the read image data being generated by a reader that reads an image of the paper sheet; and a hardware processor that: controls a conveyance speed of the paper sheet in the transferer and/or the fixer, and changes or updates the conveyance speed based on an image of the acquired read image data.

19 Claims, 18 Drawing Sheets

SPEED CONTROL TABLE

| SECTION | START POSITION ON PAPER SHEET [mm] | FIXING SPEED |
|---|---|---|
| SECTION 0 | 0 | V0 × 0. 983 |
| SECTION 1 | 10 | V0 × 0. 983 |
| SECTION 2 | 20 | V0 × 0. 983 |
| SECTION 3 | 30 | V0 × 1. 009 |
| SECTION 4 | 40 | V0 × 1. 009 |
| SECTION 5 | 50 | V0 × 1. 009 |
| SECTION 6 | 60 | V0 × 1. 009 |
| SECTION 7 | 70 | V0 × 0. 999 |
| SECTION 8 | 80 | V0 × 0. 999 |
| SECTION 9 | 90 | V0 × 0. 999 |
| SECTION 10 | 100 | V0 × 1. 009 |
| ..... | ..... | ..... |
| ..... | ..... | ..... |
| SECTION E | **0 | V0 × 0. 996 |

SPEED CONTROL TABLE

| SECTION | START POSITION ON PAPER SHEET [mm] | FIXING SPEED |
|---|---|---|
| SECTION 0 | 0 | V0 × 0. 983 |
| SECTION 1 | 10 | V0 × 0. 983 |
| SECTION 2 | 20 | V0 × 0. 983 |
| SECTION 3 | 30 | V0 × 1. 009 |
| SECTION 4 | 40 | V0 × 1. 009 |
| SECTION 5 | 50 | V0 × 1. 009 |
| SECTION 6 | 60 | V0 × 1. 009 |
| SECTION 7 | 70 | V0 × 0. 999 |
| SECTION 8 | 80 | V0 × 0. 999 |
| SECTION 9 | 90 | V0 × 0. 999 |
| SECTION 10 | 100 | V0 × 1. 009 |
| ..... | ..... | ..... |
| ..... | ..... | ..... |
| SECTION E | **0 | V0 × 0. 996 |

FIG. 7

| IMAGE DEFECT | | | |
|---|---|---|---|
| DEFECT CLASSIFICATION | ABNORMALITY OCCURRING MEMBER | ABNORMALITY OCCURRING POSITION ON PAPER SHEET | FIXING SPEED |
| IMAGE RUBBING AND SCRATCHES | CONTACT WITH UPPER GUIDE PLATE OR OTHER MEMBER | TRAILING END OF PAPER SHEET | ACCELERATION |
| TRANSFER MISALIGNMENT | TRANSFER NIP | LAST HALF (AT TIME OF CONVEYANCE IN BOTH NIPS) | DECELERATION |
| COLOR SHIFT | VIBRATION OF TRANSFER NIP / INTERMEDIATE TRANSFER BELT | LAST HALF (AT TIME OF CONVEYANCE IN BOTH NIPS) | DECELERATION |
| EXPANSION AND CONTRACTION OF IMAGE | TRANSFER NIP | LAST HALF (AT TIME OF CONVEYANCE IN BOTH NIPS) | DECELERATION |
| GLOSS UNEVENNESS | FIXING NIP | AT TIME OF CHANGING SPEED | DECREASE IN SECTION DIFFERENCE |
| IMAGE CONTAMINATION | CONTACT WITH UPPER GUIDE PLATE OR OTHER MEMBER | TRANSFER MISSING | ACCELERATION |

| PAPER SHEET DAMAGE | | | |
|---|---|---|---|
| DEFECT CLASSIFICATION | ABNORMALITY OCCURRING MEMBER | ABNORMALITY OCCURRING POSITION ON PAPER SHEET | FIXING SPEED |
| WRINKLE OF PAPER SHEET | FIXING NIP | AT TIME OF ENTERING NIP | ACCELERATION |
| WAVINESS OF PAPER SHEET | FIXING NIP | ENTIRE SURFACE | ACCELERATION |
| SCRATCH OF PAPER SHEET | CONTACT WITH GUIDE OR OTHER MEMBER | TRAILING END OF PAPER SHEET | ACCELERATION |
| FOLD OF PAPER SHEET | CONTACT WITH UPPER GUIDE PLATE OR OTHER MEMBER / AT TIME OF ENTERING FIXING NIP | LEADING END | DECELERATION |

FIG. 12

| ACTION | FIXING SPEED (Δ%) |
|---|---|
| a1 | −3.0% |
| a2 | −2.9% |
| a3 | −2.8% |
| a4 | −2.7% |
| a5 | −2.6% |
| a6 | −2.5% |
| a7 | −2.4% |
| ... | ... |
| ... | ... |
| a61 | 3.0% |

FIG. 13A

| | | ACTION (FIXING SPEED) | | | | | | | | | |
|---|---|---|---|---|---|---|---|---|---|---|---|
| | | a1 | a2 | a3 | a4 | a5 | ··· | a30 | ··· | a60 | a61 |
| STATE | S1 | 0.28 | 0.31 | 0.35 | 0.45 | 0.66 | ··· | 0.84 | ··· | 0.50 | 0.50 |
| | S2 | 0.48 | 0.53 | 0.58 | 0.70 | 0.78 | ··· | 0.76 | ··· | 0.50 | 0.50 |
| | S3 | 0.30 | 0.35 | 0.40 | 0.51 | 0.64 | ··· | 0.68 | ··· | 0.50 | 0.50 |
| | S4 | 0.50 | 0.50 | 0.55 | 0.81 | 0.88 | ··· | 0.64 | ··· | 0.50 | 0.50 |
| | S5 | 0.40 | 0.45 | 0.50 | 0.61 | 0.84 | ··· | 0.68 | ··· | 0.50 | 0.50 |
| | S6 | 0.50 | 0.50 | 0.55 | 0.81 | 0.88 | ··· | 0.64 | ··· | 0.50 | 0.50 |
| | S7 | 0.30 | 0.35 | 0.40 | 0.51 | 0.84 | ··· | 0.68 | ··· | 0.50 | 0.50 |
| | S8 | 0.50 | 0.50 | 0.55 | 0.81 | 0.88 | ··· | 0.64 | ··· | 0.50 | 0.50 |
| | ··· | ··· | ··· | ··· | ··· | ··· | ··· | ··· | ··· | ··· | ··· |
| | ··· | ··· | ··· | ··· | ··· | ··· | ··· | ··· | ··· | ··· | ··· |
| | S(n−1) | 0.40 | 0.45 | 0.50 | 0.61 | 0.84 | ··· | 0.84 | ··· | 0.50 | 0.50 |
| | Sn | 0.50 | 0.50 | 0.55 | 0.81 | 0.88 | ··· | 0.64 | ··· | 0.50 | 0.50 |

FIG. 13B

| STATE | PAPER SHEET POSITION | IMAGE ABNORMALITY (IMAGE DEFECT AND PAPER SHEET DAMAGE) |
|---|---|---|
| S1 | SECTION 0 | NORMAL |
| S2 | SECTION 0 | ABNORMAL |
| S3 | SECTION 1 | NORMAL |
| S4 | SECTION 1 | ABNORMAL |
| S5 | SECTION 2 | NORMAL |
| S6 | SECTION 2 | ABNORMAL |
| S7 | SECTION 3 | NORMAL |
| S8 | SECTION 3 | ABNORMAL |
| ... | ... | ... |
| ... | ... | ... |
| S(n−1) | SECTION E | NORMAL |
| Sn | SECTION E | ABNORMAL |

FIG. 14A

| PAPER SHEET PHYSICAL PROPERTY 1 (RIGIDITY) | |
|---|---|
| INPUT VALUE | RIGIDITY [mN] |
| 1 | 0–50 |
| 2 | 50–100 |
| 3 | 100–150 |
| 4 | 150–200 |
| 5 | 200–250 |
| 6 | 250–300 |
| 7 | 300–350 |
| 8 | 350–400 |
| 9 | 400–450 |
| 10 | 450–500 |
| 11 | 500–550 |
| 12 | 550–600 |
| 13 | 600–650 |
| 14 | 650–700 |
| 15 | 700–750 |
| 16 | 750– |

FIG. 14B

| PAPER SHEET PHYSICAL PROPERTY 2 (WATER CONTENT) | |
|---|---|
| INPUT VALUE | WATER CONTENT [%] |
| 1 | 0–4 |
| 2 | 4–6 |
| 3 | 6– |

FIG. 14C

| IMAGE FORMING CONDITION (FIXING PRESSURE) | |
|---|---|
| INPUT VALUE | FIXING PRESSURE |
| 1 | STRONG |
| 2 | MEDIUM |
| 3 | WEAK |

FIG. 14D

| USE STATE OF IMAGE FORMING APPARATUS | | |
|---|---|---|
| INPUT VALUE | TEMPERATURE | HUMIDITY |
| 1 | HIGH | HIGH |
| 2 | HIGH | MEDIUM |
| 3 | HIGH | LOW |
| 4 | MEDIUM | HIGH |
| 5 | MEDIUM | MEDIUM |
| 6 | MEDIUM | LOW |
| 7 | LOW | HIGH |
| 8 | LOW | MEDIUM |
| 9 | LOW | LOW |

FIG. 16

| STATE | PAPER SHEET POSITION | IMAGE ABNORMALITY (IMAGE DEFECT AND PAPER SHEET DAMAGE) | LOOP DETECTION SENSOR |
|---|---|---|---|
| S1 | SECTION 0 | NORMAL | OFF |
| S2 | SECTION 0 | ABNORMAL | ON |
| S3 | SECTION 0 | NORMAL | OFF |
| S4 | SECTION 0 | ABNORMAL | ON |
| S5 | SECTION 1 | NORMAL | OFF |
| S6 | SECTION 1 | ABNORMAL | ON |
| S7 | SECTION 1 | NORMAL | OFF |
| S8 | SECTION 1 | ABNORMAL | ON |
| ... | ... | ... | |
| ... | ... | ... | |
| S(2n−3) | SECTION E | NORMAL | OFF |
| S(2n−2) | SECTION E | ABNORMAL | ON |
| S(2n−1) | SECTION E | NORMAL | OFF |
| S2n | SECTION E | ABNORMAL | ON |

IMAGE FORMING APPARATUS, IMAGE FORMING SYSTEM, AND NON-TRANSITORY RECORDING MEDIUM STORING COMPUTER READABLE CONTROL PROGRAM

The entire disclosure of Japanese patent Application No. 2021-069591, filed on Apr. 16, 2021, is incorporated herein by reference in its entirety.

BACKGROUND

Technological Field

The present invention relates to an image forming apparatus, an image forming system, and a non-transitory recording medium storing a computer readable control program.

Description of the Related Art

In the commercial color printing industry, an electrophotographic image forming apparatus is widely used. In the field of production printing (PP) corresponding to the color printing industry, application to various types of paper sheets is required as compared with a case of being used in an office. In order to perform high-quality printing on these various paper sheets, there is an image forming apparatus that sets conveyance conditions according to the type of the paper sheet to be used and performs printing.

However, the number of combinations of the paper sheet types and usage conditions is increased, and a large number of development steps are required to design control assuming all the combinations. In the related art, since the control design relies on manual design, some conditions among possible combination conditions, that is, the worst conditions or representative conditions are examined, and under the specific conditions, the control design is performed so that paper sheet conveyance can be performed within a normal range. However, in this method, there is a possibility that optimum conveyance is not performed under use conditions which is not assumed. For example, when there is a difference in a conveyance speed between a transferer and a fixer, there is a case where an image defect such as transfer misalignment or image rubbing, or paper sheet damage such as a wrinkle or a scratch of the paper sheet occurs due to pulling of the paper sheet or forming of an excessive loop.

In the image forming apparatus disclosed in JP 2008-158076 A, a loop detection sensor that detects a loop of the paper sheet is disposed between the transferer and the fixer, and a speed of a drive motor of the fixer is corrected according to the detection result at predetermined time intervals to control a loop amount of the paper sheet to be constant.

However, in the image forming apparatus of JP 2008-158076 A, since the loop of the paper sheet at one measurement position is measured by one loop detection sensor, the orientation of the paper sheet at a position other than the measurement position cannot be detected, and the loop (passing height of the paper sheet in the conveyance path) at the measurement position can be detected. However, otherwise, there is still a possibility that the correct orientation of the paper sheet in the conveyance path cannot be maintained, and the image defect or the paper sheet damage occurs.

SUMMARY

The present invention has been made in view of the above circumstances, and an object thereof is to provide an image forming apparatus capable of appropriately performing paper sheet conveyance between a transferer and a fixer and reducing occurrence of an image defect and paper sheet damage, an image forming system, and a control program.

To achieve the abovementioned object, according to an aspect of the present invention, an image forming apparatus reflecting one aspect of the present invention comprises: a transferer that transfers a toner image on an image carrier formed by an image former onto a paper sheet; a fixer that heats and thereby fixes the toner image on the paper sheet; a read image acquisitor that acquires read image data of the paper sheet on a downstream side of the fixer in a conveyance direction, the read image data being generated by a reader that reads an image of the paper sheet; and a hardware processor that: controls a conveyance speed of the paper sheet in the transferer and/or the fixer, and changes or updates the conveyance speed based on an image of the acquired read image data.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 7 is a table illustrating correspondence between each defect classification included in an image defect and paper sheet damage and an occurrence position on a paper sheet;

FIG. 12 is a table illustrating action information;

FIG. 13A is an example of a Q table;

FIG. 13B is a table illustrating patterns in a state;

FIGS. 14A to 14D are tables illustrating examples of a paper sheet physical property, an image forming condition, and a use state;

FIG. 16 is a table illustrating patterns in a state according to another modification example.

DETAILED DESCRIPTION OF EMBODIMENTS

Figure 1:
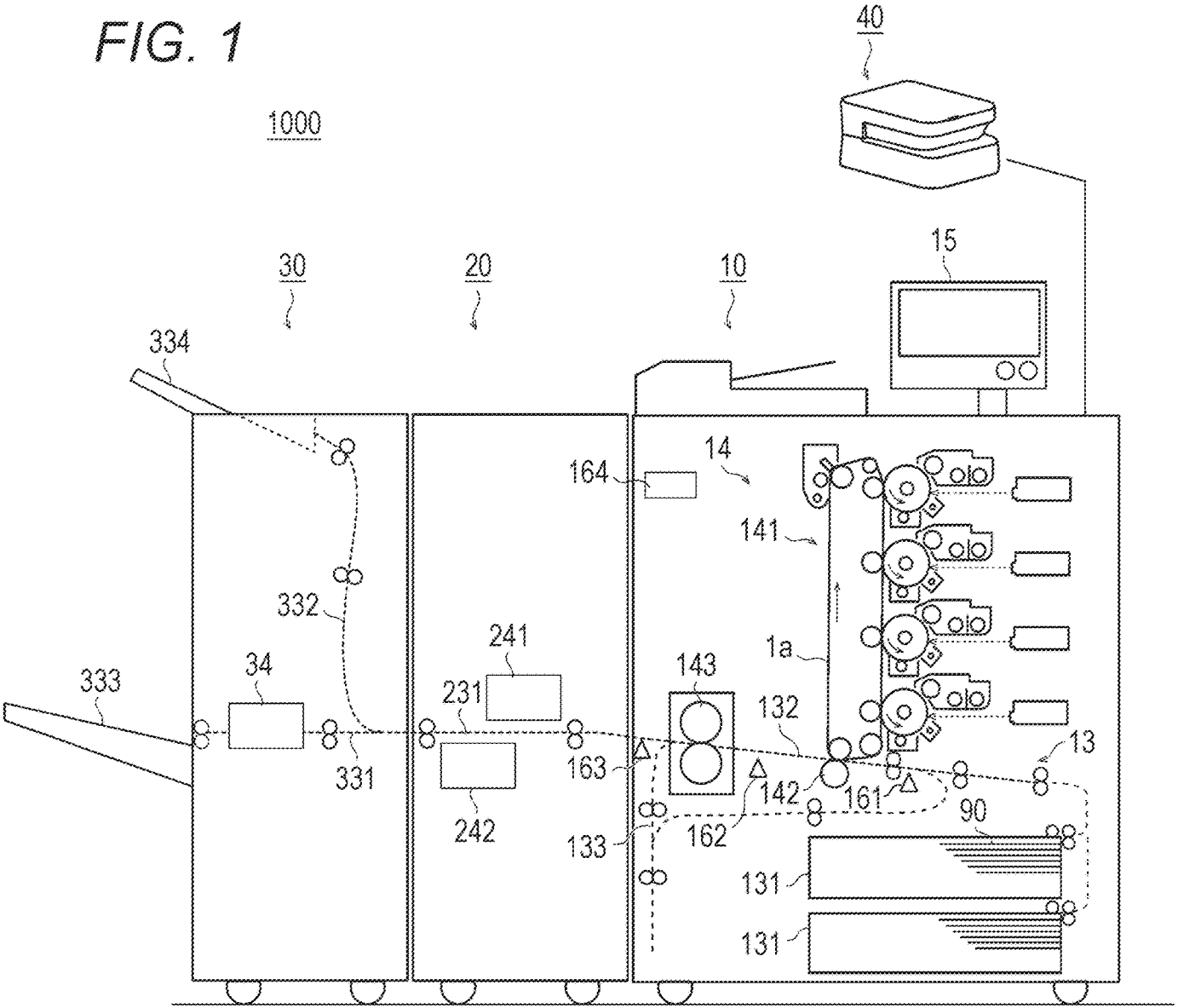
FIG. 1 is a schematic configuration diagram of an image forming system.

Hereinafter, one or more embodiments of the present invention will be described with reference to the drawings. However, the scope of the invention is not limited to the disclosed embodiments. Note that, in the description of the drawings, the same elements are denoted by the same reference numerals, and overlapping description will be omitted. Furthermore, dimensional ratios in the drawings are exaggerated for convenience of the description, and may be different from actual ratios. Furthermore, in the embodiment, a "paper sheet" includes a printing paper sheet and various films. In particular, examples of the printing paper sheet include plant-derived mechanical pulp and/or a paper sheet produced using chemical pulp. Furthermore, examples of the paper sheet type (paper type) include gloss paper (also referred to as coated paper), matte paper, plain paper, high-quality paper, and high-gloss paper.

Figure 2:
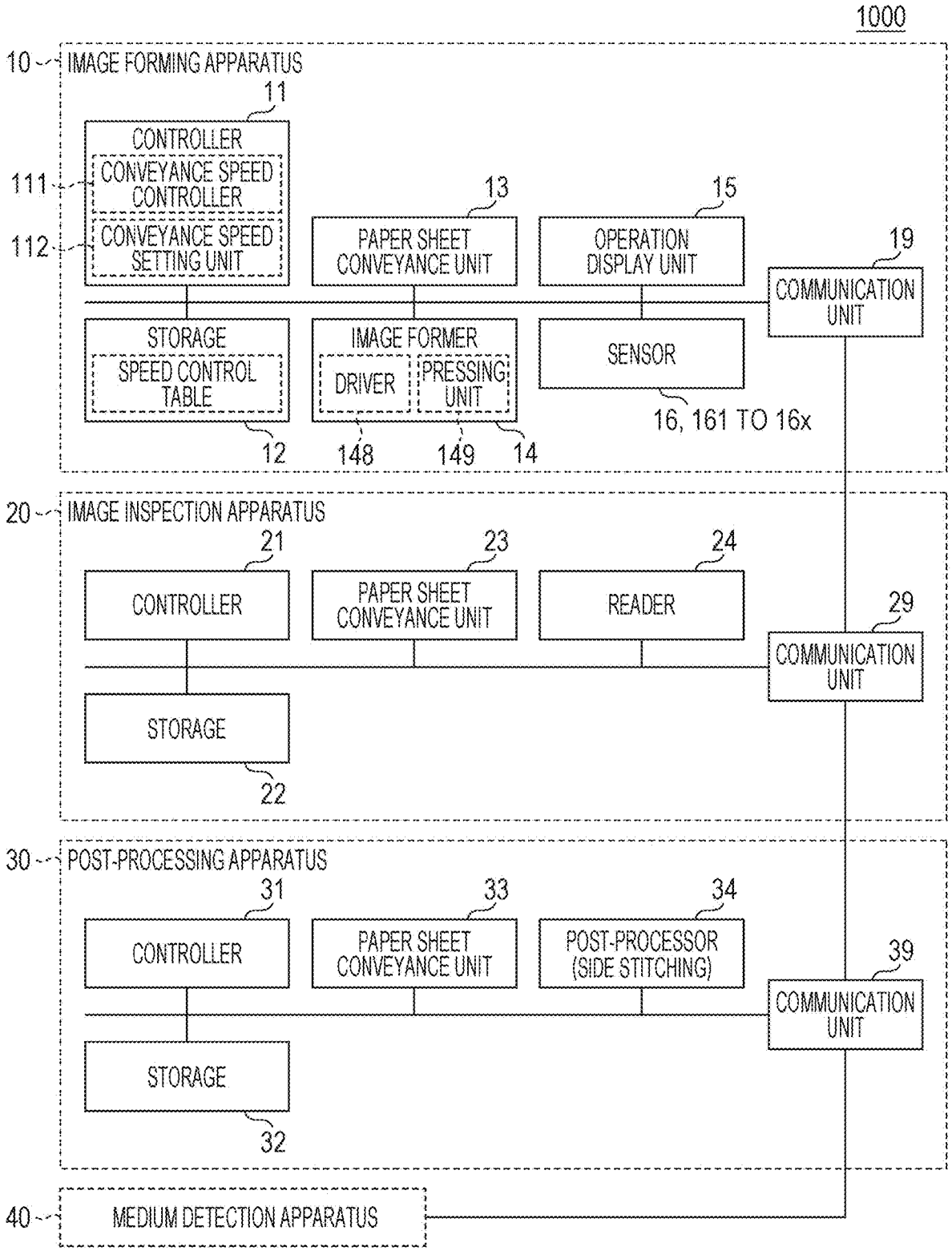
FIG. 2 is a block diagram of the image forming system.

FIG. 1 is a schematic diagram illustrating an image forming system 1000 according to an embodiment of the present invention. FIG. 2 is a block diagram illustrating a hardware configuration of the image forming system 1000.

(1) Overall Configuration

As illustrated in FIGS. 1 and 2, the image forming system 1000 includes an image forming apparatus 10, an image inspection apparatus 20, a post-processing apparatus 30, and an external medium detection apparatus 40. The image forming apparatus 10, the image inspection apparatus 20, and the post-processing apparatus 30 are connected in this order from an upstream side along a conveyance direction of a paper sheet 90.

(2) Image Forming Apparatus 10

The image forming apparatus 10 includes a controller 11, a storage 12, a paper sheet conveyance unit 13, an image former 14, an operation display unit 15, a sensor 16, and a communication unit 19.

The controller 11 includes a central processing unit (CPU) and a memory. The CPU is a control circuit including a multi-core processor that executes control for the above-described units and various types of arithmetic processing according to a program, and each function of the image forming apparatus 10 is exerted by the CPU executing the corresponding program. The memory is a high-speed accessible main storage device as a work area, which temporarily stores a program and data. As the memory, for example, a dynamic random access memory (DRAM), a synchronous dynamic random access memory (SDRAM), a static random access memory (SRAM), or the like is adopted.

The controller 11 controls the entire image forming apparatus 10. The controller 11 functions as a conveyance speed controller 111 and a conveyance speed setting unit 112. Furthermore, the controller 11 of the image forming apparatus 10 controls the entire image forming system 1000 in cooperation with the controllers 21 and 31 of other apparatuses.

The storage 12 is a large-capacity auxiliary storage device that stores various programs including an operating system and various data. As a storage, for example, a hard disk, a solid state drive, a flash memory, a read only memory (ROM), or the like is adopted. The storage 12 stores, as speed control information, a speed control table in which a speed control value of a driver 148, which corresponds to each conveyance position (conveyance section) on the paper sheet 90 nipped by the transferer 142 and the fixer 143, is set. In this speed control table, among a plurality of drive motors included in the driver 148, driving speeds corresponding to the respective conveyance positions on the paper sheet of the drive motors (hereinafter, referred to as a transfer motor and a fixing motor, respectively,) of the transferer 142 and the fixer 143 are set. The speed control table is changed and updated by the conveyance speed setting unit 112. Furthermore, there are a plurality of types of speed control tables (FIG. 4 to be described later) stored in the storage 12 corresponding to the paper sheet physical property or the paper sheet type, and the paper sheet passing mode (single-sided/double-sided). Here, the paper sheet physical property is measured by the medium detection apparatus 40 to be described later or set by the user via the operation display unit 15. The paper sheet physical property is stored in association with the paper sheet stored in a paper sheet feeding tray 131. The paper sheet physical property includes rigidity, a water content, and a grain direction of the paper sheet.

The paper sheet conveyance unit 13 includes a plurality of the paper sheet feeding tray 131, a conveyance path 132, and a conveyance path 133, the conveyance paths 132 and 133 being provided with a plurality of conveyance rollers. The paper sheet feeding tray 131 stores a plurality of paper sheets 90, feeds the paper sheets one by one, and sends the paper sheets to the conveyance path 132.

(Image former 14)

The image former 14 includes an image former 141, a transferer 142, a fixer 143, a driver 148, a pressing unit 149.

The image former 141 includes writing units and drum units, the writing units and drum units corresponding to respective basic colors of yellow (Y), magenta (M), cyan (C), and black (K), and an intermediate transfer belt 1*a*. Each of the drum units includes a cylindrical photosensitive drum, a charging electrode, a developing unit, and a cleaning unit. The developing unit of each drum unit storms two-component developer containing toner of a color corresponding to the basic color.

A toner image of each color formed by the drum unit is sequentially transferred to a surface of the intermediate transfer belt 1*a* at a transfer nip with a primary transfer roller, superimposed, and then transferred to the paper sheet 90 conveyed to the transfer nip with the transferer 142 which is a secondary transferer. In the example illustrated in FIG. 1, the intermediate transfer belt 1*a* functions as an image carrier, and the toner image formed on the surface of the intermediate transfer belt 1*a* is transferred to the paper sheet 90. Note that, in a case where the toner image formed on one or a plurality of the photosensitive drums is directly transferred to the paper sheet without the intermediate transfer belt 1*a*, the photosensitive drum functions as an image carrier.

In the image former 141, start timing of exposure (writing) of the writing unit and paper sheet conveyance timing of a registration roller immediately upstream of the transferer 142 are synchronized with each other in accordance with image formation start timing. After a leading end of the paper sheet 90 is abutted against the registration roller stopped by a clutch or the like and temporarily stopped, the toner image and the paper sheet are aligned at the transfer nip position by synchronizing the leading end of the paper sheet 90 with the leading end position of the image on the intermediate transfer belt 1*a*, and executing restart at a predetermined timing to start the conveyance of the paper sheet 90.

As the transferer 142, a foamed roller, a solid roller, or the like is used. The transferer 142 forms a transfer nip by coming into pressure contact with an opposing roller inscribed in the intermediate transfer belt 1*a*.

The fixer 143 includes a heating roller incorporating a heater, and a pressure roller. The fixer 143 includes a temperature sensor that measures a temperature of the heating roller and a heater that heats the heating roller. Power supply to the heater is controlled based on temperature information of the temperature sensor so that the heating roller is set in control temperature. A fixing control temperature of the fixer 143 is controlled according to a basis weight or a thickness of the paper sheet. For example, for thick paper, the fixing control temperature is set to be higher that of plain paper. The pressure roller comes into contact with the heating roller at a predetermined pressure, and the transfer toner image on the paper sheet 90 conveyed to the fixing nip formed by both rollers is heated and pressed. According to this, an image is formed on the paper sheet 90. Furthermore, in a case where the image forming apparatus 10 or the image forming system 1000 is turned on and cold-started in a state in which the temperature of the fixer 143 is close to a room temperature, an elapsed time from the power-on is measured. The measured time is used as a heat storage time that is the elapsed time after the fixing temperature is controlled. Note that, in a case where the power is turned on after a predetermined time has elapsed since the power-off or in a case where the temperature of the fixer 143 is equal to or lower than a predetermined temperature when the power is turned on, it is determined that the cold start is performed.

The paper sheet passing mode includes a single-sided mode and a double-sided mode. In the case of the single-sided mode, the paper sheet 90 that has passed through the fixer 143 and has an image formed on a front surface is conveyed as it is to an apparatus on a downstream. On the other hand, in the case of the double-sided mode, the paper sheet 90 that has passed through the fixer 143 is conveyed to the conveyance path 133 for conveyance of a sheet for double-sided printing, is reversed by a switchback path, and then passes through the conveyance path 132 again, and an image is formed on a back surface by the image former 14.

(Driver 148 and Pressing unit 149)

As described above, the driver 148 includes a plurality of the drive motors independently driven, the drive motors including a transfer motor for the transferer 142 and a fixing motor for the fixer 143. A driving speed of the transfer motor and/or the fixing motor is controlled according to a speed control value set in the speed control table. For example, in the embodiment, the transfer motor that drives the transferer 142 is rotated at a constant speed during image formation, and the driving speed is not changed during the image formation. On the other hand, a speed of the fixing motor that drives the fixer 143 is changed at a predetermined cycle (corresponding to a section 1 to a section E to be described later) during the image formation according to the setting of the speed control table. In a case where a clock frequency of the image former 141 is changed by the vertical magnification adjustment, the driving speed of the transferer 142 is adjusted in synchronization, and then, the image former is driven at a constant speed at the adjusted driving speed.

The pressing unit 149 changes the pressure of the nip of the transferer 142 and/or the fixer 143. Specifically, the pressing unit 149 includes a drive source including a solenoid and a motor, an arm, and a cam, and changes the pressure applied to a rotation shaft of the roller of the transferer 142 and the rotation shaft of the pressure roller of the fixer 143. For example, the thickness of the paper sheet 90 changes the fixing pressure at the fixing nip to strong, medium, or weak depending on the thick paper, the plain paper, or the thin paper. Furthermore, in the case of embossed paper having much unevenness, a transfer pressure is set to a pressure higher than that of the plain paper.

The operation display unit 15 includes a touch panel, a numeric keypad, a start button, and a stop button, and is used to display various information and input various instructions. The user can set paper sheet information such as the size and type of paper sheets stored in each paper sheet feeding tray via the operation display unit 15. Furthermore, the paper sheet physical property can be input. For example, the grain direction of the paper sheet can be input as the physical property.

The sensor 16 includes a plurality of sensors 161 to 16*x* disposed in the apparatus. The sensors 161 and 163 are optical sensors and are also referred to as paper sheet detection sensors. The sensors 161 and 163 detect the presence (or absence) of the paper sheet 90 at a place where the conveyance path 133 is disposed, and transmit the detection result to the controller 11. Among the paper sheet detection sensors, the sensor 161 is also particularly referred to as a registration sensor. Note that, although only two paper sheet sensors are illustrated as examples, a large number of the paper sheet sensors are disposed in the middle way of each conveyance path of the image forming system 1000 and in the vicinity of a branch point. The sensor 162 is a loop detection sensor (hereinafter, referred to as a loop detection sensor 162), includes an actuator and an optical sensor, and outputs signals at a plurality of levels according to the passing position (passing height) of the paper sheet 90 on the conveyance path 133. The sensor 164 is disposed in a main body of the image forming apparatus 10, and detects temperature and humidity (relative humidity).

The communication unit 19 is an interface for communicating with other apparatuses via the image inspection apparatus 20, the post-processing apparatus 30, and the network. The communication unit 19 functions as the read image acquisitor, acquires read image data from the image inspection apparatus 20 and acquires the measurement result (paper sheet physical property) from the medium detection apparatus 40.

(Image Inspection Apparatus 20)

As illustrated in FIGS. 1 and 2, the image inspection apparatus 20 includes a controller 21, a storage 22, a paper sheet conveyance unit 23, a reader 24, and a communication unit 29. These are connected to each other via a signal line such as a bus for exchanging signals.

The controller 21 and the storage 22 have the same configuration as that of the controller 11 and the storage 12. The controller 21 performs image adjustment and image inspection of the image forming system 1000, and setting of the speed control table in cooperation with the controller 11 of the image forming apparatus 10. The paper sheet conveyance unit 23 includes a conveyance path 231, a plurality of conveyance rollers disposed on the conveyance path 231, and a drive motor (not illustrated) that drives the conveyance rollers. The conveyance path 231 is connected to the conveyance path 132 on the upstream side, receives the paper sheet 90 on which an image is formed by the image forming apparatus 10, and sends the paper sheet 90 to the post-processing apparatus 30 on the downstream side. The storage 22 (or the storage 12) stores image data such as a color chart in which color patches of a plurality of colors for various evaluations are disposed, an inspection chart in which a plurality of grid images and trim mark images for position shift detection are disposed, and a "conveyance evaluation chart" including uniform density of a single color halftone (for example, monochrome) used for changing the speed control table and a horizontal thin line of each color for detecting color shift or expansion or contraction of an image.

(Reader 24)

The reader 24 includes first and second image readers 241 and 242. Since both the image readers have the same configuration, the first image reader 241 will be described below as an example. The first image reader 241 is disposed above the conveyance path 231, and the second image reader 242 is disposed below the conveyance path 231. In the double-sided mode, in a case where an image is formed on the front and back surface of the paper sheet 90 by the image forming apparatus 10, simultaneous (one pass) reading of both surface is performed by the first and second image readers 241 and 242.

Two first and second image readers 241 and 242 have the same configuration. The first image reader 241 includes a sensor array, a lens optical system, a light emitting diode (LED) light source, and a housing that stores these components. The sensor array is a color line sensor in which a plurality of optical elements (for example, charge coupled devices (CCDs)) are disposed in a line along a main scanning direction, and a reading area in a width direction corresponds to the entire width of the paper sheet 90. The optical system includes a plurality of mirrors and a lens. Light from the LED light source passes through a document glass and is radiated to the front surface of the paper sheet 90 passing the reading position on the conveyance path 231. The image at the reading position is guided by the optical system and formed on the sensor army. For example, resolution of the first image reader 241 is 100 to several hundred dpi.

The read image data obtained by the first image reader 241 or the second image reader 242 is analyzed by the controller 21 or the controller 11 and used for various determination processing.

For example, as "color determination", color data of each color patch is analyzed based on read image data obtained by reading the paper sheet 90 on which an image of the color chart is formed by the image forming apparatus 10, and the result data is sent to the image forming apparatus 10. The image forming apparatus 10 adjusts an LUT for color conversion (conversion from print data to CMYK signals of the writing unit), gamma correction, screen correction, and adjustment of density balance, or adjusts image forming conditions of the image former 14, based on the result data. Furthermore, as "image position determination", a position of each trim mark image is analyzed based on read image data obtained by reading the paper sheet 90 on which an image of the inspection chart is formed by the image forming apparatus 10, and the result data is sent to the image forming apparatus 10. Based on the result data, the image forming apparatus 10 adjusts parameters of two-dimensional position correction, such as skew and shift.

Furthermore, in a case of determining paper sheet conveyance on the conveyance path 132 between the transferer 142 and the fixer 143, the image inspection apparatus 20 sends, to the image forming apparatus 10, read image data obtained by reading the paper sheet 90 on which an image of the "conveyance evaluation chart" is formed by the image forming apparatus 10. The controller 11 of the image forming apparatus 10 analyzes the behavior of the paper sheet based on the acquired read image data, and changes and updates the speed control table used for speed control of the driver 148.

(Post-Processing Apparatus 30)

As illustrated in FIGS. 1 and 2, the post-processing apparatus 30 includes a controller 31, a storage 32, a paper sheet conveyance unit 33, a post-processor 34, and a communication unit 39, and performs processing on the paper sheet 90 in cooperation with other apparatuses on the upstream side. The controller 31 and the storage 32 have the same configuration as that of the controllers 11 and 21, and the storages 12 and 22, respectively. The paper sheet conveyance unit 33 includes conveyance paths 331 and 332, a plurality of conveyance rollers disposed on these conveyance paths 331 and 332, a drive motor (not illustrated) that drives the conveyance rollers, and paper sheet discharge trays 333 and 334. For example, the paper sheet 90 for normal printing to be described later is discharged to the paper sheet discharge tray 333, and the paper sheet 90 for pre-printing is discharged to the paper sheet discharge tray 334.

The post-processor 34 performs staple processing. Furthermore, various types of post-processing such as punching processing and booklet forming processing may be performed. For example, the post-processor 34 includes a stack unit that stacks paper sheets and a stapling unit, and after a plurality of the paper sheets 90 are stacked in the stack unit, the stapling unit performs side stitching processing using a staple.

(Medium Detection Apparatus 40)

The medium detection apparatus 40 includes a paper thickness detector, a basis weight detector, a surface property detector, a water content detector, a rigidity detector (all not illustrated). In the case of the external attachment type as illustrated in FIG. 1, the user inserts the paper sheet 90 carried by hand into a paper sheet passing area of a measuring instrument, and operates a measurement start button of the apparatus main body or the measurement start button of the operation display unit 15 of the image forming apparatus 10 to measure the paper sheet physical property of the paper sheet 90. Note that as a modification example, a built-in type medium detection apparatus may be used. For example, in the built-in type medium detection apparatus, the conveyance path (for example, the conveyance path 132) of the image forming apparatus 10 is configured to be a measurement area. Furthermore, in the embodiment, an example in which paper type discrimination is performed on the image forming apparatus 10 side will be described, but the paper type discrimination may be performed on the medium detection apparatus 40 side.

The paper thickness detector includes a pair of conveyance rollers of which at least one is movable according to the thickness of the paper sheet 90 passing through the nip, and a measurement unit that measures an inter-shaft distance of a pair of the conveyance rollers. The measurement unit includes, for example, an actuator, an encoder, a light emitter and a light receiver. The paper thickness detector outputs the measurement result (measurement value 1) of the thickness of the paper sheet 90.

The basis weight detector is a sensor that detects the basis weight of the paper sheet 90, includes a light emitter and a light receiver, and measures the basis weight by an attenuation amount of light transmitted through the paper sheet 90. For example, a basis weight sensor has the light emitter disposed below the paper sheet passing area (paper sheet passing path) into which the paper sheet is inserted, and the light receiver disposed above the paper sheet passing area. In this configuration, the paper sheet 90 passes between the light emitter and the light receiver, and the basis weight sensor detects the basis weight of the paper sheet 90 based on intensity of the light received by the light receiver to output the measurement result (measurement value 2).

The surface property detector includes a housing, a light emitter, a collimating lens, and a plurality of light receivers, and optically detects regular reflection light and diffuse reflection light from a paper sheet surface as described below. A guide plate above the paper sheet passing area is provided with an opening (measurement area), and the opening serves as an irradiation area of the light receiver. The paper sheet 90 inserted to a position of the opening is pressed by a pressing mechanism lifted from below the paper sheet passing area. In this state, light made substantially parallel by the collimating lens is radiated from the light emitter at an incident angle of 75° with respect to a reference surface. The wavelength of the irradiation light is, for example, 465 nm. A plurality of the light receivers receive the regular reflection light and the diffuse reflection light. For example, the light receivers are disposed at three places with reflection angles of 30 degrees (for diffuse reflection light), 60 degrees (for diffuse reflection light), and 75 degrees (for regular reflection light), or two places with angles of 60 degrees and 75 degrees. The surface property detector outputs a signal of the light receiver as the measurement result (measurement value 3) of the paper sheet physical property.

The water content detector includes, for example, a near infrared type of water content sensor that optically detects a light absorption amount of an OH group. The water content sensor uses a property that the paper sheet 90 is irradiated with light of a predetermined wavelength in a near infrared region, and absorbance of the light changes according to the water content of the paper sheet 90. Furthermore, as another example, the water content may be measured by measuring a variation in the amount of light of a reflection component inside the paper sheet by using the reflection light separated by a deflection filter. The water content detector outputs, for example, the water content as the measurement result of the paper sheet physical property.

The rigidity detector detects a physical property according to rigidity of the paper sheet. For example, when the paper sheet is conveyed to a bent conveyance path, on the bent conveyance path, the rigidity detector mechanically measures a force with which the paper sheet pushes one outer guide plate constituting the conveyance path or a displacement amount of the paper sheet. The rigidity detector outputs the rigidity as the measurement result of the paper sheet physical property. The measurement result is converted into a rigidity value (mN) and output (see FIG. 14A to be described later). Furthermore, by rotating the paper sheet 90 by 90 degrees and conveying the paper sheet to the conveyance path, the rigidity of each of the vertical grain and the horizontal grain is obtained and, thus, the directions of the vertical grain and the horizontal grain can be determined.

Furthermore, the image forming apparatus 10 performs paper type discrimination from the measurement result (measurement values 1 to 3) obtained from the medium detection apparatus 40. The storage 12 of the image forming apparatus 10 stores a learning model obtained by machine learning (also referred to as a trained model) used for paper type discrimination. This is a learning model generated by supervised learning using training data, with detection output of the medium detection apparatus 40 for the paper sheet 90 as an input value and paper type information of the paper sheet 90 set by the user as a correct label. The controller 11 of the image forming apparatus 10 obtains a basis weight conversion value, a paper thickness conversion value, and a surface property measurement value by using the measurement result (measurement values 1 to 3) obtained by measuring the paper sheet 90 by using the paper thickness detector, the basis weight detector, and the surface property detector of the medium detection apparatus 40. Note that, here, as the basis weight conversion value, a basis weight M and a basis weight difference (basis weight index value) are calculated from the values of a first basis weight and a second basis weight by using a coefficient determined by the surface property measurement value of the measurement value 3 and surrounding environment information (temperature and humidity (for example, detected by the sensor 164 for temperature and humidity)) of the image forming system 1000 and a calculation equation. Here, the basis weight difference=the first basis weight−the second basis weight. The basis weight detector includes a plurality of LEDs that emit irradiation light having different wavelengths. The first basis weight is obtained by using a first LED that outputs irradiation light having a wavelength (750 nm to 900 nm) and a transmission light amount of the irradiation light passing through the paper sheet 90. The second basis weight is obtained by using a second LED that outputs irradiation light having a wavelength (400 nm to 470 nm) and a transmission light amount of the irradiation light passing through the paper sheet 90. Regarding the paper type discrimination, by using the learning model, the surface property measurement value, the basis weight difference, and the density (=the basis weight M/the paper thickness) are input and a "paper type score" of each candidate paper type is obtained as an output. The controller 11 determines a paper type having the highest paper type score as a paper type or presents the paper type to the user as the candidate paper type.

(Paper Sheet Conveyance Control)

Figure 3A:
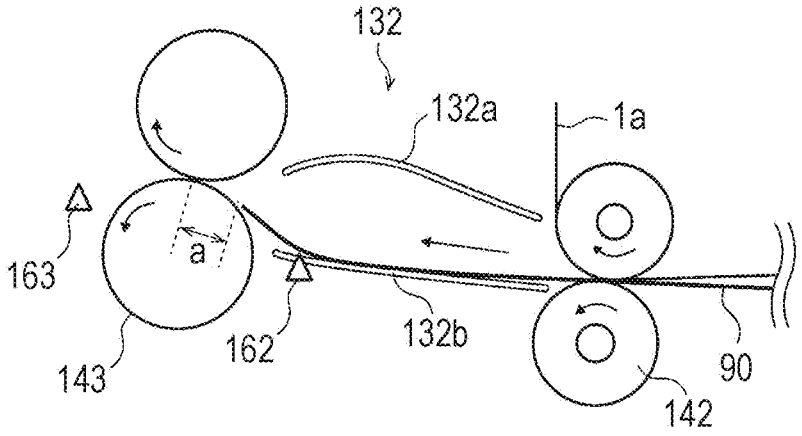
FIGS. 3A and 3B are schematic views illustrating start timing and end timing of paper sheet conveyance control.
Figure 3B:
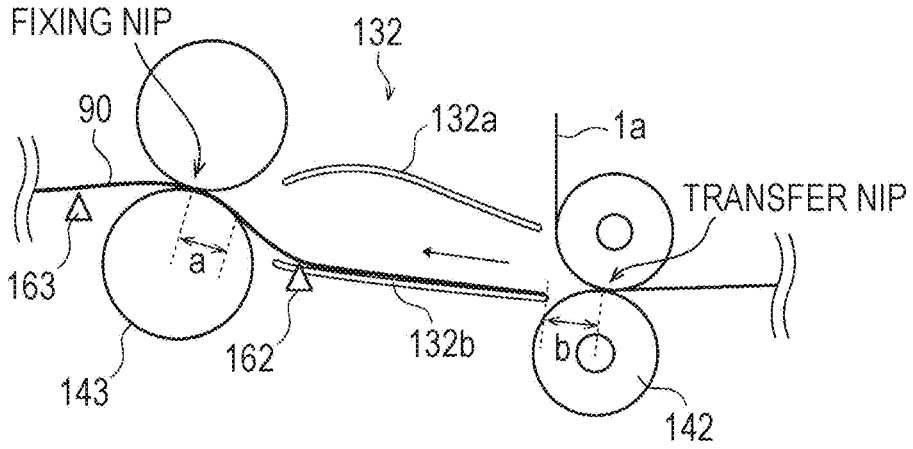

Next, the paper sheet conveyance control will be described with reference to FIGS. 3A, 3B, and 4. In the embodiment to be described below, an example will be described in which the conveyance speed controller 111 controls the driving speed of the fixing motor at the time of conveying the paper sheet 90, sets the speed of the transferer 142 to a constant speed, and controls only the speed of the fixer 143. FIGS. 3A and 3B are schematic diagrams illustrating start timing and end timing of the paper sheet conveyance control. FIGS. 3A and 3B are partially enlarged views of FIG. 1, and illustrate the periphery of the conveyance path 132 between the transferer 142 and the fixer 143. The conveyance path 132 includes an upper guide plate 132*a* and a lower guide plate 132*b*. A hole is provided substantially at the center of the lower guide plate 132*b* in the width direction, and the distal end of the actuator of the loop detection sensor 162 protrudes upward from below the hole with a weak biasing force. The actuator is pushed by the paper sheet 90 and moved up and down according to the height of the paper sheet 90 passing therethrough, and detects a loop amount (passing height) of the paper sheet 90 with two stages, three stages, or four stages of resolution according to the vertical movement.

FIG. 3A is a schematic view illustrating the start timing of the paper sheet conveyance control. The start timing is a time point before the leading end of the paper sheet 90 reaches the fixing nip, that is, a time point when the leading end of the paper sheet 90 reaches a position upstream of the fixing nip by a predetermined distance a. The leading end position of the paper sheet 90 and the timing can be calculated from drive time (rotation amount) after the registration roller is restarted.

FIG. 3B is a schematic view illustrating the end timing of the paper sheet conveyance control. The end timing is a predetermined time point after a trailing end of the paper sheet 90 passes through the transfer nip, that is, a time point when the trailing end of the paper sheet 90 reaches a position downstream of the transfer nip by a processing distance b. The leading end position of the paper sheet 90 and the timing can be calculated by information regarding a length of the paper sheet 90 in the conveyance direction (hereinafter, simply referred to as "paper sheet length"), and the drive time after the sensor 163 reaches the leading end of the paper sheet 90 or the drive time after the registration roller is restarted.

Figure 4:
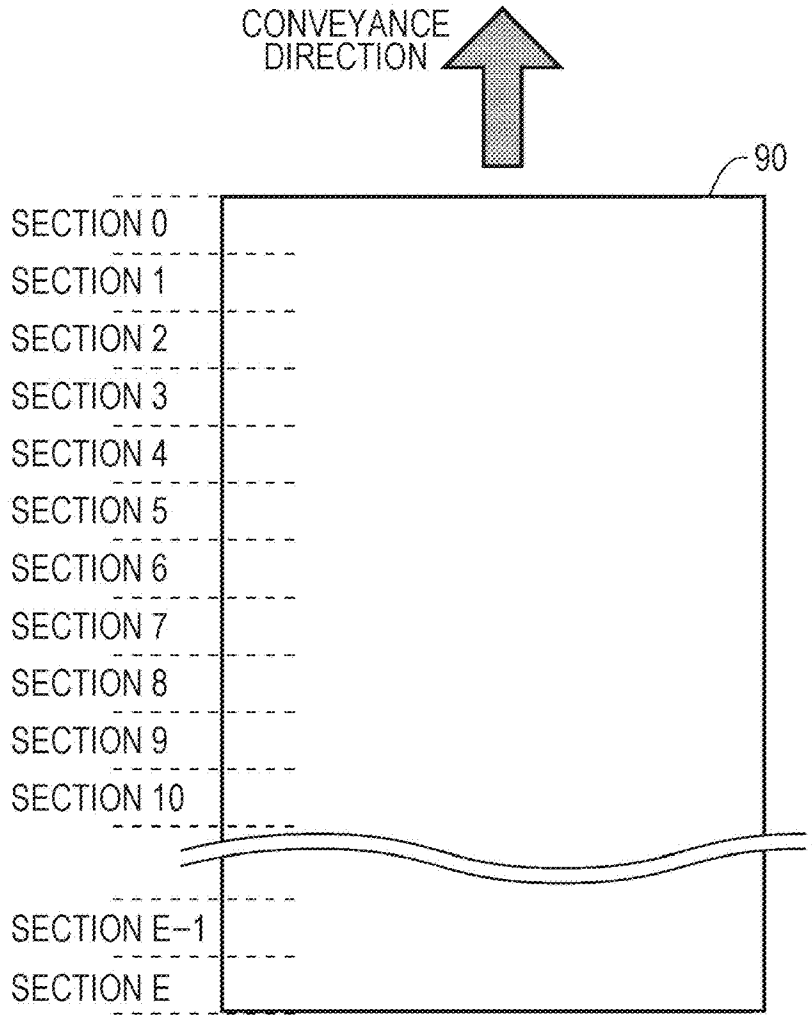
FIG. 4 is a schematic diagram illustrating a section corresponding to a position of a paper sheet in a conveyance direction and a speed control table.

FIG. 4 is a schematic diagram illustrating a section corresponding to a position of the paper sheet in the conveyance direction and the speed control table. A plurality of sections 0 to E are provided at predetermined intervals of 1 mm to more than ten mm in order from the leading end of the paper sheet. In the example illustrated in FIG. 4, each of the predetermined intervals corresponds to 10 mm on the paper sheet 90. The start of the section 0 corresponds to the start timing of FIG. 3A, and the end of the section E corresponds to the end timing of FIG. 3B. The number of the sections (=E+1) depends on the paper sheet length of the paper sheet 90. For example, when the paper sheet length is 420 mm, the number of the sections is 42. Note that in a case where the paper sheet length of the paper sheet 90 to be used cannot be exactly divided at predetermined intervals, the trailing end of the paper sheet is positioned in the midway of the section E.

In the speed control table illustrated in FIG. 4, a speed control value of the fixer 143 of each Section is described and stored in the storage 12. There are a plurality of the speed control tables, and each of the speed control tables corresponds to a print condition. The print condition includes a paper sheet physical property. As described above, the paper sheet physical property includes rigidity, a water content, and a grain direction of the paper sheet. As the paper sheet physical property such as the rigidity, the water content, or the grain direction of the paper sheet, a paper sheet physical property obtained by the measurement of the medium detection apparatus 40 may be used. The driving speed of the fixing motor is controlled according to the speed control value set in the speed control table. V0 is a reference speed, for example, 200 mm/sec to 500 mm/sec. At the reference speed V0, the conveyance speed of the fixer 143 is the same as the conveyance speed of the transferer 142. As illustrated in FIG. 4, in the section 0, the fixing motor is controlled with a fixing speed control value of "V0×0.983", and in the section 1, the fixing motor is controlled with the same fixing speed control value of "V0×0.983". Note that the driving speed can be controlled in units of 0.1%. Furthermore, the transfer motor that drives the transferer 142 is controlled at a constant driving speed which is a constant conveyance speed (process speed) during the image formation. Furthermore, the fixing motor of the fixer 143 is controlled at a constant speed at the reference speed V0 before the section 0, that is, until the paper sheet 90 reaches the position of FIG. 3A after the registration roller is restarted and after the paper sheet 90 reaches the position of FIG. 3B, or after the section E.

(Processing of Changing Speed Control Table)

Figure 5A:
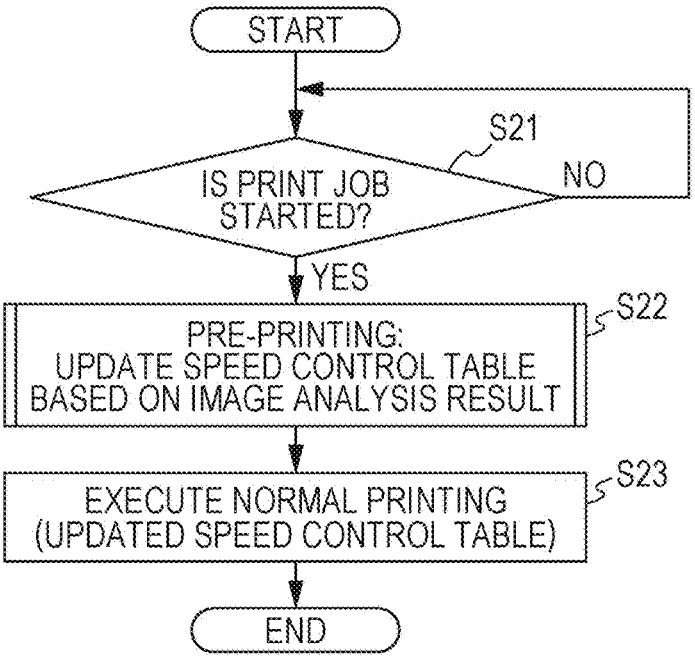
FIG. 5A is a flowchart illustrating processing of changing a speed control table according to a first embodiment.

FIG. 5A is a flowchart illustrating processing of changing the speed control table according to a first embodiment.

(Step S21)

When receiving a print job from the user via the operation display unit 15, the image forming apparatus 10 starts the print job (YES). The received print job data includes print data and a job ticket. A print condition is described in the job ticket, and the print condition includes paper sheet information such as paper type information, a basis weight, a paper sheet size, and a paper sheet physical property, and a paper sheet passing mode (single-sided/double-sided). Furthermore, the paper sheet information may be associated with the paper sheet feeding tray that uses a paper sheet physical property measured by the medium detection apparatus 40 and/or a paper type (paper sheet type) determined from the paper sheet physical property, and a basis weight, and this may be used as the paper information.

(Step S22)

The controller 11 performs pre-printing under the print conditions of the print job and updates the speed control table. The update processing here will be described later.

(Step S23)

The image forming apparatus 10 performs normal printing for the print job started in Step S21. At this time, the conveyance speed controller 111 controls the conveyance of the paper sheet 90 by using the speed control table updated in Step S22.

Processing of Updating Speed Control Table (Step S221)

Figure 5B:
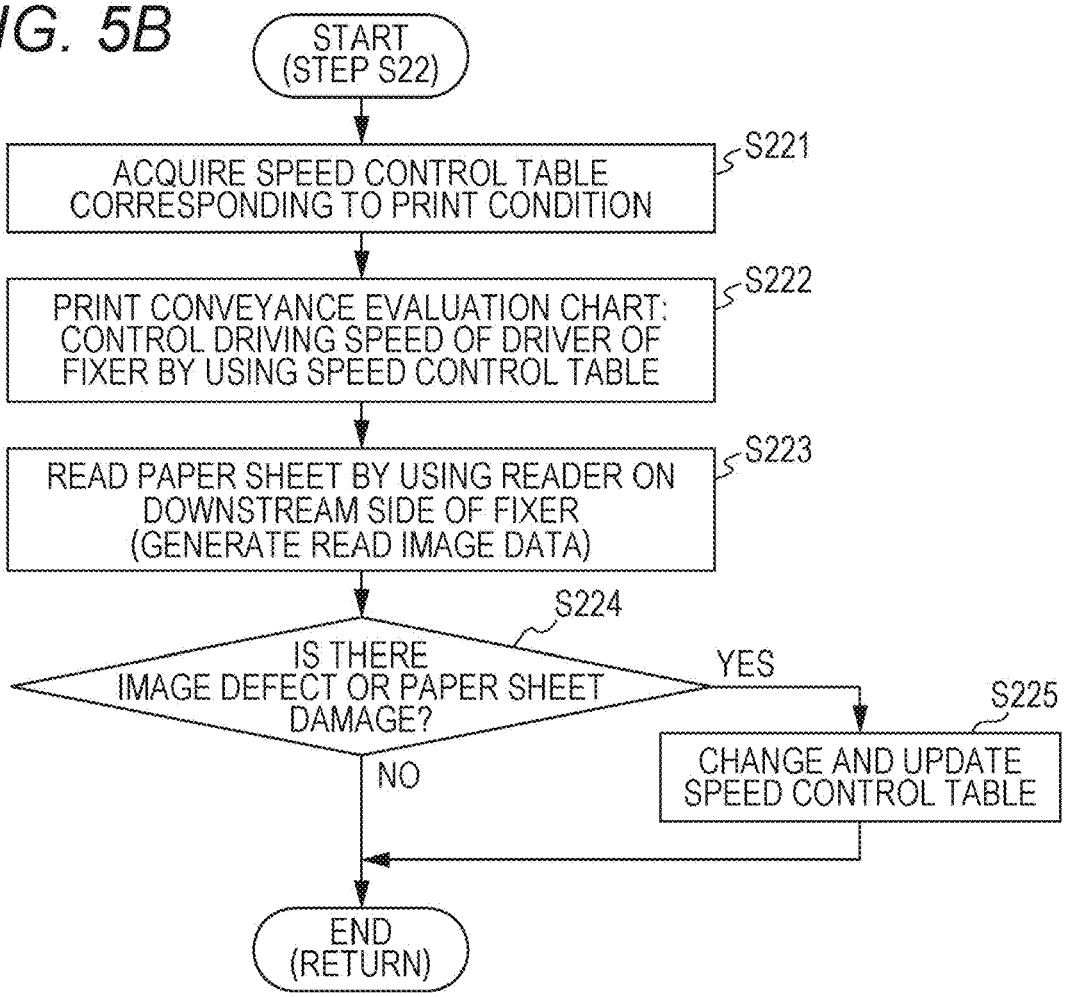
FIG. 5B is a subroutine flowchart illustrating processing in Step S22 of FIG. 5A.

FIG. 5B is a subroutine flowchart illustrating processing in Step S22 of FIG. 5A.

In Step S221, the controller 11 acquires the speed control table corresponding to the print condition from the storage 12. For example, there are a plurality of the speed control tables according to the print conditions such as the paper type and the basis weight or the rigidity, and the speed control table with a condition that matches with or is the closest to the condition is acquired from a plurality of the speed control tables.

(Step S222)

The controller 11 performs pre-printing by using image data of the "conveyance evaluation chart". In the pre-printing, image formation is started under the print conditions of the print job. Furthermore, in the pre-printing, the conveyance speed controller 111 uses the speed control table acquired in Step S221 to perform conveyance control of the paper sheet 90 at the time of the image formation.

(Step S223)

In the case of the single-sided mode, in the image inspection apparatus 20, the first image reader 241 on the downstream side of the fixer 143 reads an image on the paper sheet 90 having passed through the fixer 143, and the read image data is generated. In the case of the double-sided mode, in the image inspection apparatus 20, the first and second image readers 241 and 242 read both sides of the paper sheet 90, and two read image data are generated. The controller 11 acquires the read image data generated by the image inspection apparatus 20 via the communication unit 19. The paper sheet 90 on which the image of the conveyance evaluation chart is formed is discharged to, for example, the paper sheet discharge tray 334 as a sub tray.

(Step S224)

The conveyance speed setting unit 112 analyzes the read image data. In this analysis, it is determined whether or not an image defect and/or paper sheet damage has occurred. The image defect includes at least one of image rubbing, transfer misalignment, color shift, expansion or contraction of an image, gloss unevenness, and image contamination. Furthermore, the paper sheet damage includes at least one of a wrinkle of the paper sheet, waviness of the paper sheet, a scratch of the paper sheet, and fold of the paper sheet. The conveyance speed setting unit 112 determines that the image defect or the paper sheet damage has occurred in a case where similarity is high when pattern images respectively corresponding to the image defect and the paper sheet damage are compared, the pattern images being stored in advance in the storage 12 (hereinafter, the image defect and the paper sheet damage may be collectively referred to as "image abnormality"). Note that the waviness is determined by the occurrence of periodic focus blur of the read image.

When there is the image defect or the paper sheet damage (YES), the processing proceeds to Step S225. When there is not the image defect or the paper sheet damage (NO), the processing is ended, and the processing returns to the processing of FIG. 5A.

(Step S225)

The conveyance speed setting unit 112 changes the speed control table in a case where there is occurrence of the image abnormality (image defect or paper sheet damage) or based on the occurrence position of the image abnormality, and updates the content of the storage 22 with the changed speed control table.

Figure 6:
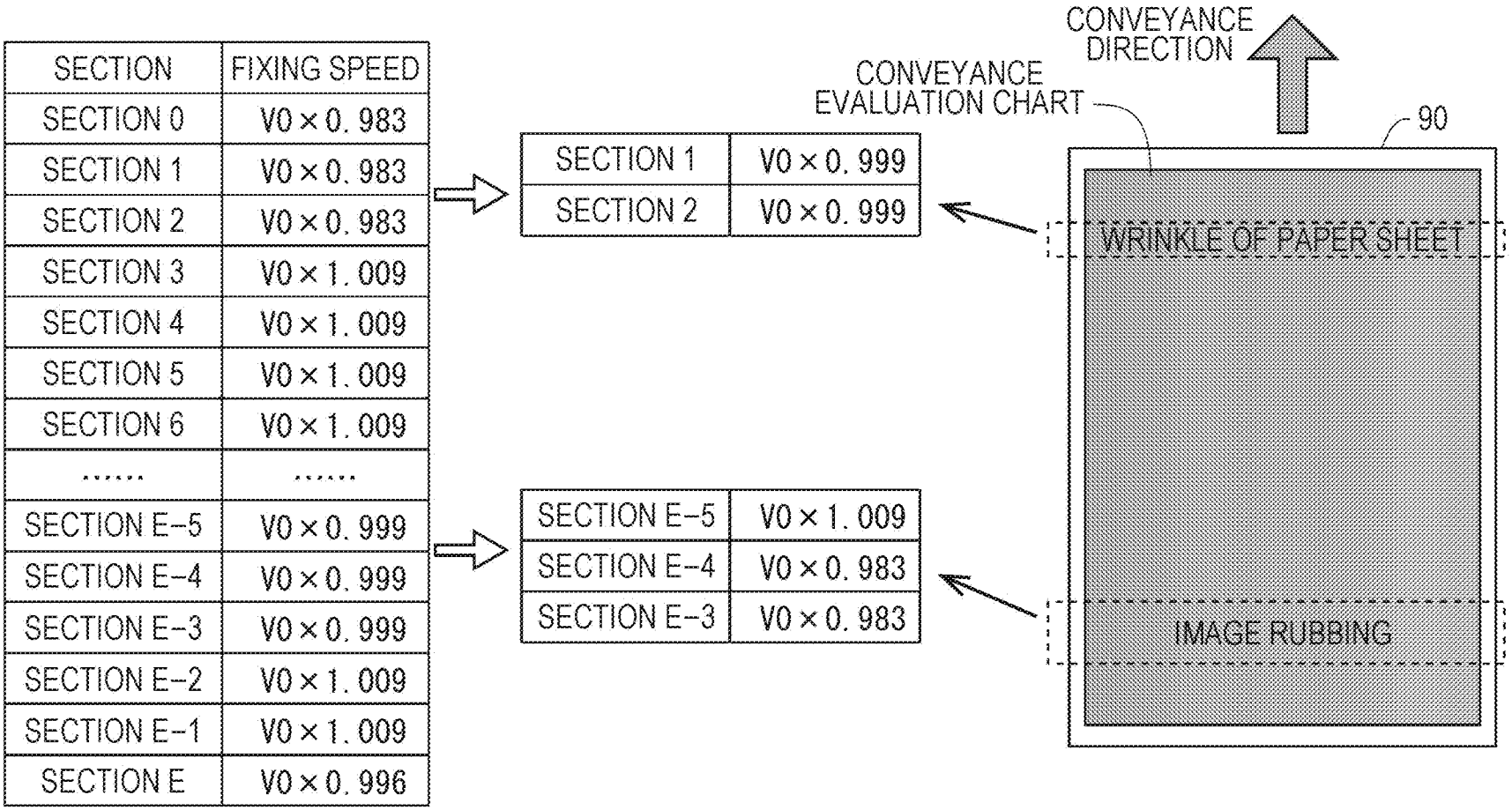
FIG. 6 is a schematic diagram illustrating an occurrence position of an image abnormality and a change section of a speed control table.

FIG. 6 is a schematic diagram illustrating the occurrence position of the image abnormality and a change section of the speed control table. FIG. 7 is a table illustrating correspondence between each defect classification included in the image defect and the paper sheet damage and the occurrence position on the paper sheet.

For example, as illustrated in FIG. 6, in a case where a wrinkle of the paper sheet is generated on the conveyance evaluation chart on the leading end side, the speed control values of the sections 1 and 2 corresponding to the position in which the wrinkle is generated are changed. Furthermore, in a case where the image rubbing occurs on the trailing end side, the speed control values of sections E-5 to E-3 are changed. As illustrated in the table of FIG. 7, the relationship between the abnormality classification and the correction for the abnormality occurring member, the abnormality occurring position on the paper sheet, and the fixing speed is set in the storage 12 in advance, and the speed control table of the position (section) corresponding to the abnormality occurring position is changed according to classification for the occurring abnormality.

As described above, the image forming apparatus according to the first embodiment includes: the conveyance speed controller that controls the conveyance speed of the paper sheet in the transferer and/or the fixer, the read image acquisitor that acquires read image data of the paper sheet, the read image data being generated by a reader that reads the image of the paper sheet on the downstream side of the fixer in the conveyance direction; and the conveyance speed setting unit that changes or updates the conveyance speed based on the image of the acquired read image data. According to this, the paper sheet conveyance between the transferer and the fixer can be appropriately performed, and the occurrence of the image defect and the paper sheet damage can be reduced. Furthermore, more specifically, the image forming apparatus includes: the conveyance speed controller that controls the driving speed of the driver of the fixer at the time of the image formation based on the speed control table for controlling the conveyance speed of the paper sheet of the fixer, the speed control table being stored in the storage; and the conveyance speed setting unit that analyzes the image of the acquired read image data and changes the speed control table based on the analysis result. According to this, the paper sheet conveyance between the transferer and the fixer can be appropriately performed, and the occurrence of the image defect and the paper sheet damage can be reduced.

Modification Example

In the first embodiment, the image forming apparatus 10 automatically changes the speed control value of the speed control table in a case where the occurrence of the image abnormality is determined. On the other hand, in the modification example to described below, permission from the user is received before changing the speed control value of the speed control table.

Figure 8:
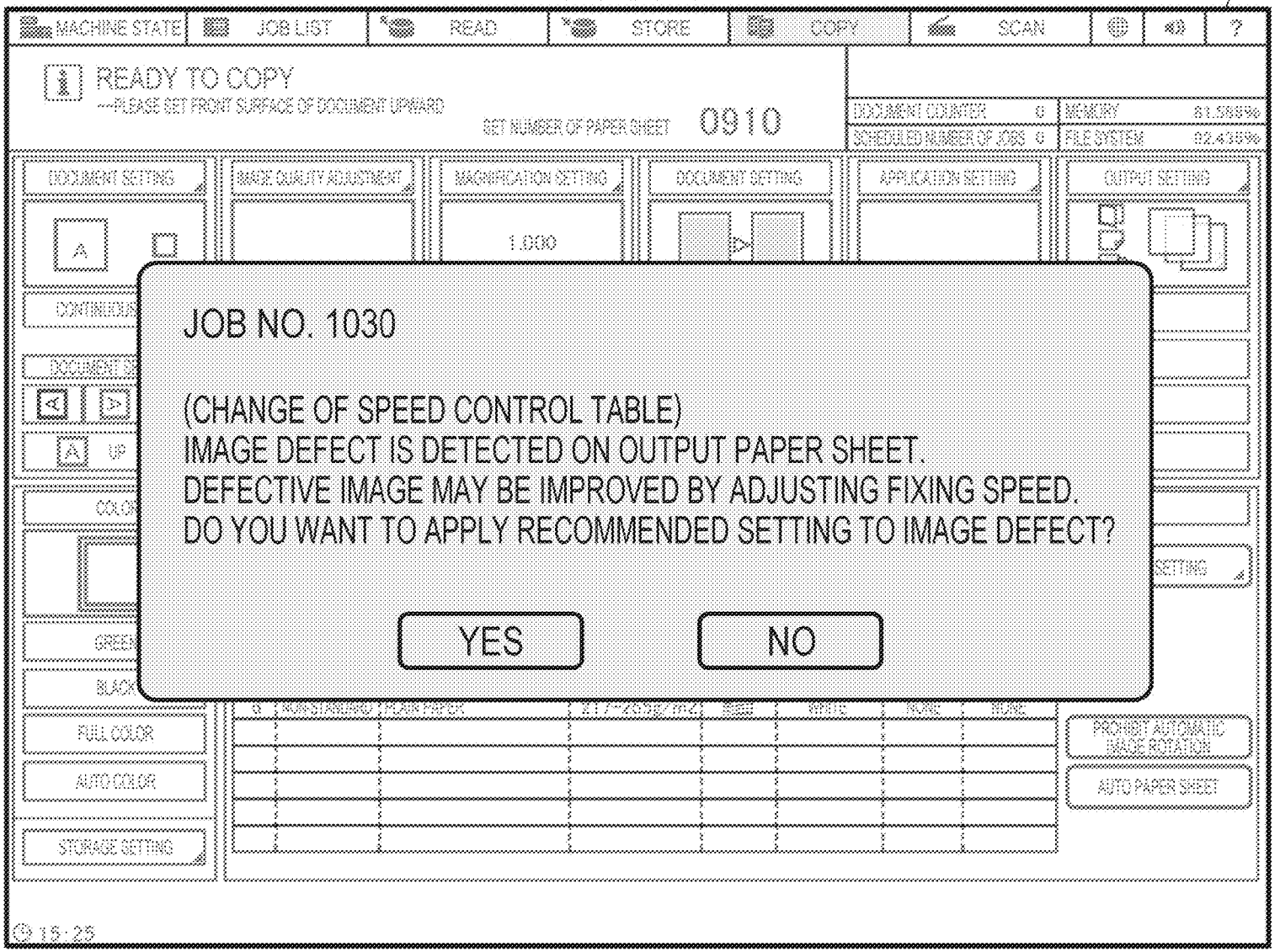
FIG. 8 is an example of an operation screen for receiving permission from a user according to a modification example.

FIG. 8 is an example of an operation screen 151 for receiving the permission from the user according to the modification example. In the modification example, the operation display unit 15 functions as a setting reception unit. The controller 11 displays the operation screen 151 on the operation display unit 15 when changing the speed control table in Step S255 of FIG. 5A. In a case where a "YES" button is operated on the operation screen 151 to obtain the permission from the user, the controller 11 changes the speed control table. On the other hand, in a case where a "NO" button is operated on the operation screen 151, the processing returns to the previous speed control table without any change.

As described above, in the modification example, the speed control table is changed after the permission from the user is received. According to this, it is possible to prevent the speed control table from being changed against the intention of the user.

Second Embodiment

Figure 9:
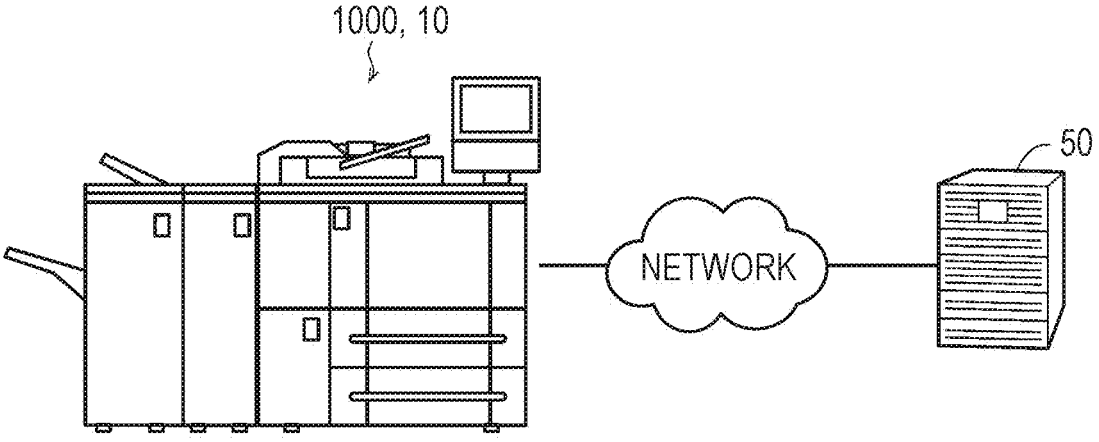
FIG. 9 is a schematic configuration diagram of an image forming system according to a second embodiment.
Figure 10:
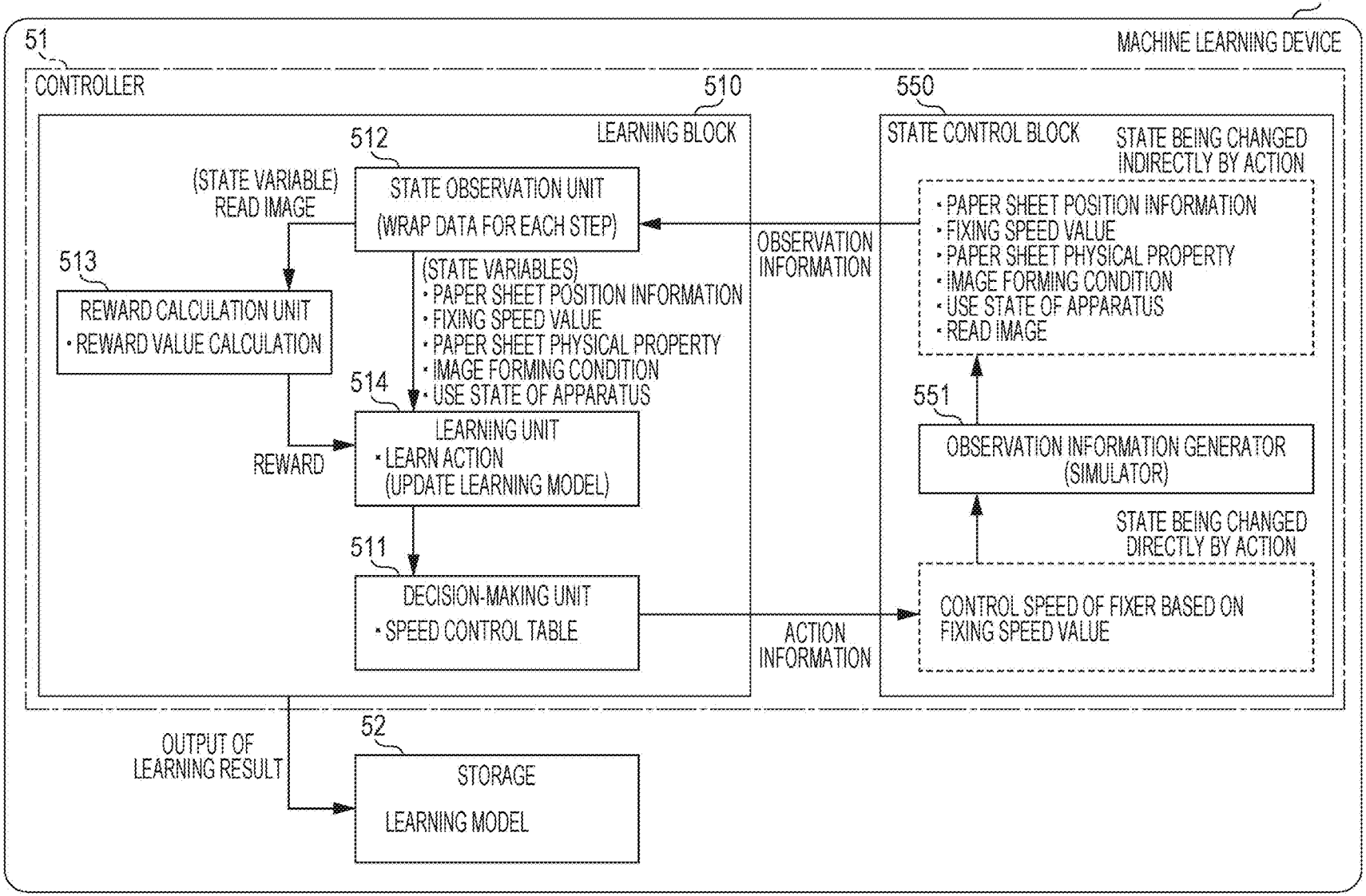
FIG. 10 is a block diagram illustrating a function of a machine learning device.

FIG. 9 is a schematic configuration diagram illustrating an image forming system 10000 including a machine learning device 50 and an image forming apparatus 10 according to the second embodiment. FIG. 10 is a block diagram illustrating a function of the machine learning device 50. The image forming apparatus 10 and the machine learning device 50 are connected via a network. As will be described later, the machine learning device 50 learns an action related to paper sheet conveyance in the apparatus, particularly, paper sheet conveyance between the transferer 142 and the fixer 143, and generates a machine learning model (hereinafter, simply referred to as a learning model). The generated learning model is sent to the image forming apparatus 10. The image forming apparatus 10 uses the acquired learning model to change the speed control table for conveyance control.

Note that the machine learning device 50 illustrated in FIG. 9 includes a controller 51, a storage 52, and a network I/F. The controller 51 includes a plurality of CPUs, a plurality of graphics processing units (GPUs), a RAM, a ROM, and functions as a learning block 510 and a state control block 550. The storage 52 stores the learning model. The machine learning device 50 may be an on-premises server or a cloud server using a commercial cloud service. Furthermore, as another example, the machine learning device 50 may be integrated with the image forming system 1000 or the image forming apparatus 10. For example, in the other example, by causing an engine control system-on-a-chip (SoC) in the controller 31 of the image forming apparatus 10 to function as a machine learning device, a learning model is generated by machine learning in the image forming apparatus 10.

The machine learning device 50 calculates a reward obtained when a certain action is taken in a certain state according to a predetermined rule, calculates an action value (Q value) according to a predetermined calculation equation so as to optimize the total sum of the rewards, and updates the Q table. According to this, an action is learned, and an action is determined (an action having the highest action value is selected) based on the learning result.

Here, assuming that a learning coefficient is $\eta$, a time discount rate is $\gamma$, and a reward at time t is $R_t$, the action value ($Q(s_t, a_t)$) can be calculated by, for example, the following equation (1) of Q-learning.

[Mathematical formula 1]

$$Q(s_t, a_t) = Q(s_t, a_t) + \eta * \left(R_{t+1} + \gamma \max_a Q(s_{t+1}, a) - Q(s_t, a_t)\right) \quad \text{Equation (1)}$$

(Generation of Learning Model)

Figure 11A:
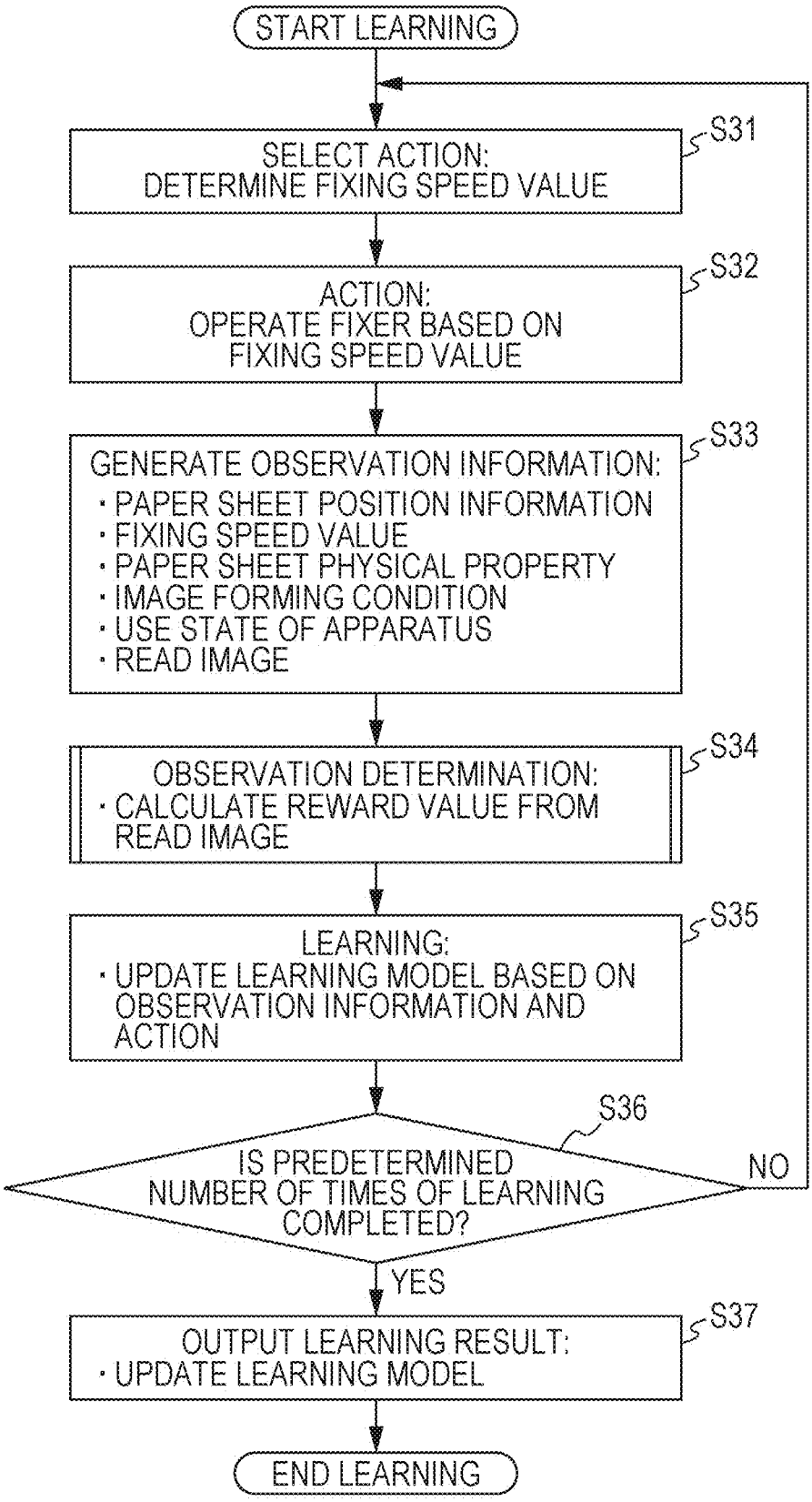
FIG. 11A is a flowchart illustrating learning processing of the machine learning device.
Figure 11B:
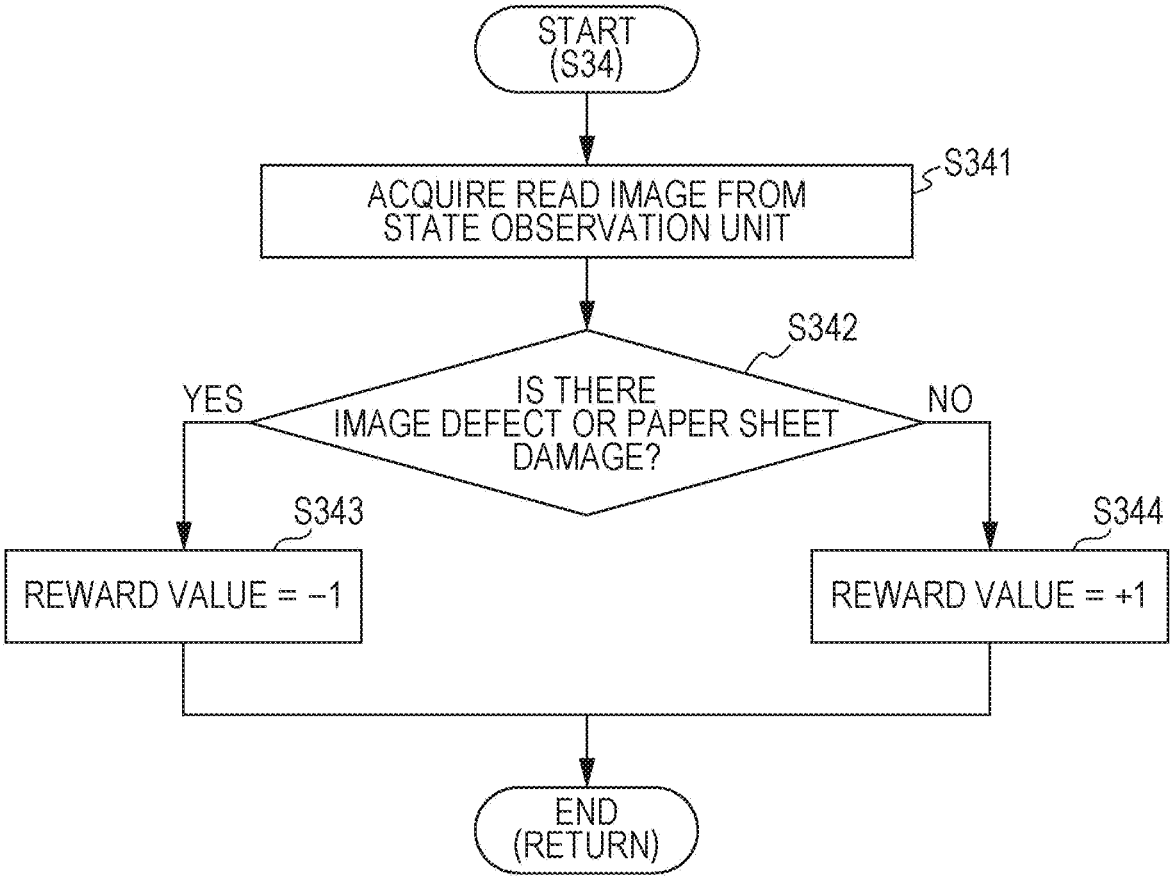
FIG. 11B is a subroutine flowchart illustrating reward provision processing in Step S34 of FIG. 11A.

Hereinafter, a machine learning method of the learning model used in the present embodiment will be described with reference to FIG. 10 and FIGS. 11A to 14D. FIGS. 11A and 11B are flowcharts illustrating learning processing executed by the machine learning device 50. FIGS. 12 to 14D are diagrams illustrating a table-type learning model according to an embodiment.

As illustrated in FIG. 10, the controller 51 of the machine learning device 50 functions as the learning block 510 and the state control block 550.

The learning block 510 includes a decision-making unit 511, a state observation unit 512, a reward calculator 513, and a learning unit 514. The state control block 550 includes an observation information generator 551. In the example illustrated in FIG. 10, the state control block 550 of the machine learning device 50 may acquire information regarding the use state of the apparatus and the image forming condition, the information being stored in the storage 12, from the image forming apparatus 10, and according to this, the paper sheet conveyance state of the image forming apparatus 10 may be reproduced (simulated). Note that, in the following example, one print equivalent time is used as a time step. For example, one print equivalent time is 0.5 seconds to several seconds. In the embodiment illustrated in FIG. 10 and FIG. 11A, one time step corresponds to one episode.

(Step S31)

A reference is made to FIG. 11A. In this step, the decision-making unit 511 determines and outputs action information (also referred to as a speed instruction) regarding drive control for the fixing motor that drives the fixer 143 based on a state in the time step of the current time point (current cycle). Hereinafter, this action information is also referred to as an action. The action information is a fixing speed value corresponding to the speed control table (see FIG. 4).

FIG. 12 is a table illustrating the action information. In FIG. 12, for the driving speed of the fixing motor that drives the fixer 143, the same speed as the reference speed V0 is set to 0.0% of the reference speed, and a plurality of actions a1 to a61 can be taken in a range of −3.0% to +3.0% (deceleration to acceleration) in increments of 0.1%. This action can be selected with reference to the current state based on the Q table illustrated in FIG. 13A. In an initial stage of the learning, a random numerical value or a predetermined numerical value may be input as the numerical value in the Q table. For example, in the latter case, a numerical value divided equally by the number of possible actions (1/61 when there are 61 actions) is input as a predetermined value. In an initial state in which the learning is not progressed, an action may be randomly selected at a constant rate by a ε-greedy method. For example, a fixed value ε is used (for example, any value in a range of 0 or more and less than 1 and 0.1 to 0.3). Alternatively, the calculation may be performed by the calculation equation set so as to decrease z as the learning proceeds, for example, the calculation equation halving e every time the number of time of the learning reaches a predetermined value or the calculation equation dividing c by the maximum value of the action value Q ($s_t$, $a_t$) obtained from the current state ($s_t$).

(Step S32)

The state control block 550 controls the fixer 143 based on the action information received in Step S31. Specifically, the fixing motor is driven with a fixing speed value based on the speed instruction.

(Step S33)

The observation information generator 551 generates (1) the position information of the paper sheet 90 being conveyed. (2) the speed state of the fixer 143, (3) the paper sheet physical property. (4) the image forming condition, (5) the use state of the image forming apparatus, and (6) each information of the read image, in the environment of the conveyance path between the transferer 142 and the fixer 143 (hereinafter, referred to as observation information). The generated observation information is transferred to the state observation unit 512 of the learning block 510.

FIGS. 14A to 14D are tables illustrating examples of the observation information. As an example of the paper sheet physical property, FIG. 14A illustrates the rigidity, and FIG. 14B illustrates the water content. Furthermore, FIG. 14C illustrates fixing pressure as an example of the image forming condition, and FIG. 14D illustrates the temperature and humidity of the surrounding environment information of the apparatus as an example of the use state of the image forming apparatus. As the paper sheet physical property, the measurement result of the medium detection apparatus 40 can be used. Furthermore, the temperature and humidity can be detected by the sensor 164.

FIG. 13B is a table illustrating a pattern in one state. Each state corresponds to a section (see FIG. 4) corresponding to the position of the paper sheet 90 and the determination result of the presence or absence of the image abnormality (image defect or paper sheet damage) in the section. The total number of the states depends on the paper sheet size. For example, in the case of an A3 size paper sheet, there are 42 sections corresponding to a length of 420 mm in the conveyance direction, and the total number of the states is 84 by multiplying the sections by two of presence/absence of the abnormality.

(Step S34)

The reward calculator 513 calculates a reward value by using a skew state. FIG. 11B is a subroutine flowchart illustrating processing of providing a reward value in Step S34.

(Step S341)

The reward calculator 513 acquires the read image of the paper sheet of the current cycle from the state observation unit 512.

(Step S342)

The reward calculator 513 analyzes the mad image and determines whether or not there is an image defect or paper sheet damage. When there is the image defect or the paper sheet damage (YES), the processing proceeds to Step S343. When there is not the image defect or the paper sheet damage (NO), the processing proceeds to Step S344.

(Step S343)

Here, the reward calculator 513 gives a negative reward value, that is, a reward value=−1.

(Step S344)

Here, the reward calculator 513 gives a positive reward value, that is, a reward value=+1. After the processing of the subroutine illustrated in FIG. 11B, the processing returns to the processing illustrated in FIG. 11A again.

(Step S35)

In Step S35 illustrated in FIG. 11A, the learning unit 514 updates the learning model from the observation information, the action information, and/or the reward value. For example, in the example illustrated in FIG. 10, the action is learned by calculating the action value (Q value) by using the reward value and the equation (1) of the Q-learning described above, and the Q table is updated. The above processing is learning of one episode.

Note that the learning model may be applied to a neural network learning model as another learning model. For example, observation information (st: a pattern in one state) at certain timing (for example, a previous time step) is input, and an output ($a_t$: each action (action information)) and Q ($s_t$, $a_t$) at that time are obtained by a neural network. The learning unit 514 adjusts a parameter such that Q ($s_t$, $a_t$) approaches "$R_{t+1}+\gamma \max Q\ (s_{t+1},\ a_{t+1})$" (difference E is reduced). For example, by performing processing called back propagation (error backwards propagation), the parameter is adjusted and updated so that the error of the comparison result is reduced, and the learning is performed.

(Step S36)

When a predetermined number of times of the learning has not been completed (for example, several tens of thousands of times) (NO), the controller 51 returns the processing to Step S31 and repeats the subsequent processing. When the number of times of the learning has reached a predetermined number of times (YES), the processing proceeds to Step S37.

(Step S37)

The controller 51 of the machine learning device 50 outputs the updated learning result to the storage 52, updates the learning model, and ends the learning processing (end). This learning model is transmitted to the image forming apparatus 10 and also stored in the storage 12.

(Processing of Changing Speed Control Table in Second Embodiment)

Figure 15:
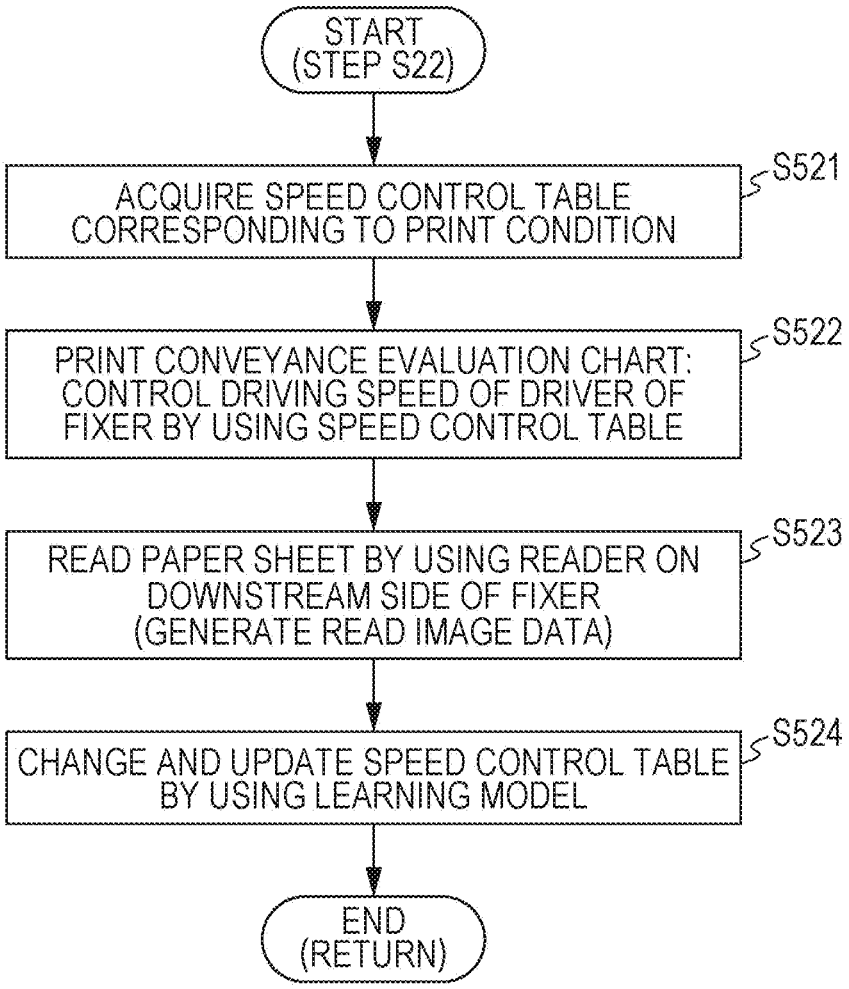
FIG. 15 is a subroutine flowchart illustrating processing in Step S22 in FIG. 5A, which uses a learning model, according to the second embodiment.

FIG. 15 is a flowchart illustrating processing of changing the speed control table by using the learning model according to the second embodiment. FIG. 15 is a subroutine flowchart illustrating processing in Step S22 of FIG. 5A. Note that, in the second embodiment, a main routine flowchart is the same as that of the first embodiment illustrated in FIG. 5A, and the description thereof will be omitted.

(Steps S521 to S523)

Here, the controller 11 performs processing similar to the processing in Steps S221 to S223 of FIG. 5B. Specifically, the controller 11 acquires the speed control table corresponding to the print condition from the storage 12, and performs pre-printing in which the image of the conveyance evaluation chart is printed using the speed control table. The image forming apparatus 10 acquires read image data which the image inspection apparatus 20 generates by reading the output of the communication unit 19 which is the acquisition unit.

(Step S524)

By using the learning model stored in the storage 12, the controller 11 obtains the speed control table by using the read image data, the speed control table used in Step S522, the paper sheet physical property, the image forming condition, and the use state of the apparatus. The speed control table before update, which is stored in the storage 12, is updated with the obtained speed control table. The speed control table is generated in accordance with a combination of print conditions (paper sheet physical property, image forming condition, and use state of apparatus). For example, in the examples illustrated in FIGS. 14A to 14D, 1296 patterns (=16×3×3×9) are generated in the paper sheet physical property (16 stages of rigidity×three stages of water content), the image forming conditions (three stages), and the use state (nine stages). The updated speed control table is used for conveyance control of the paper sheet 90 in the normal printing (Step S23 in FIG. 5A).

As described above, in the image forming apparatus according to the second embodiment, the speed control table defining the speed control information, that is, the speed control value of the driver for each conveyance position is determined using the learning model stored in the storage. According to this, the paper sheet conveyance between the transferer and the fixer can be appropriately performed, and the occurrence of the image defect and the paper sheet damage can be reduced.

Another Modification Example

In the second embodiment, as illustrated in FIG. 13B, the state corresponds to the paper sheet position and the presence or absence of the image abnormality (image defect or paper sheet damage), but in addition to this, the output of the loop detection sensor 162 may be further added. FIG. 16 is a table illustrating patterns in a state according to another modification example. By adding the output of the loop detection sensor 162 to the input in this manner, it is possible to generate a learning model capable of outputting a more accurate speed control table.

The configurations of the image forming apparatus 10, the image forming system 1000 including the image forming apparatus 10, and the machine learning device 50 described above have been described as main configurations in describing the features of the embodiments described above, and are not limited to the configurations described above, and various modifications can be made as follows within the scope of claims. For example, the present invention can be configured as the following modification examples. Furthermore, the configuration included in the general image forming apparatus 10 is not excluded.

Modification Example 2

In the speed control table used in the first embodiment (see FIG. 4), the speed control value of the driver 148 is set for each conveyance position on the paper sheet 90, but the speed control value is not limited thereto, and a uniform speed value may be set for the entire surface of the paper sheet 90. Furthermore, as another example, the speed control table may be described at a relative speed with respect to a transfer speed. For example, the case where the transfer speed is the same as the reference speed V0 has been described as an example, but in a case where the transfer speed is slightly changed from the reference speed by vertical magnification adjustment, the value of the speed control table is shifted by this change. Moreover, in the first and second embodiments, the speed control value of the fixer 143 is described in the speed control table, but the speed control value of the transferer 142 or the speed control values of both the transferer 142 and the fixer 143 may be described.

Modification Example 3

In the second embodiment, the fixing pressure has been described as an example of the image forming condition, but the transfer pressure, the paper sheet passing mode, and the fixing control temperature, which are set by the pressing unit 149, may be used as other image forming conditions.

Modification Example 4

In the second embodiment, the surrounding environment information is illustrated as an example of the use state of the apparatus, but the use amount (corresponding to a wear amount) of the members such as the heating roller and the pressure roller of the fixer 143 or the heat storage time of the fixer 143 may be used as other use states.

Modification Example 5

In the first and second embodiments, the speed control table is changed and updated by analyzing the image of the conveyance evaluation chart, but the present invention is not limited thereto, and the speed control table may be changed and updated by analyzing the image of the normal printing. Furthermore, in this case, in a case where the four sides of the paper sheet are cut based on the trim mark image as the final product, in the normal printing, an image similar to the conveyance evaluation chart may be printed on the outer side of the paper sheet that is not used, and the speed control table may be changed and updated by analyzing the image. Furthermore, in a case where the image of the normal printing is analyzed and the speed control table is changed and updated, statistical processing (for example, averaging) may be performed on several or several tens of analysis results to change and update the speed control table.

Means and methods for performing various processes in the machine learning device and the image forming apparatus, which are described above, can be realized by either a dedicated hardware circuit or a programmed computer. The program may be provided with, for example, a computer-readable recording medium such as a USB memory or a digital versatile disc (DVD)-ROM, or may be provided online via a network such as the Internet. In this case, the program recorded in the computer-readable recording medium is usually transferred to and stored in the storage such as a hard disk. Furthermore, the program may be provided as independent application software, or may be incorporated into the software of the apparatus as one function.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus comprising:

a transferer that transfers a toner image on an image carrier formed by an image former onto a paper sheet;

a fixer that heats and thereby fixes the toner image on the paper sheet;

a read image acquisitor that acquires read image data of the paper sheet on a downstream side of the fixer in a conveyance direction, the read image data being generated by a reader that reads an image of the paper sheet; and a hardware processor that:

controls a conveyance speed of the paper sheet in the transferer and/or the fixer; and changes or updates the conveyance speed based on an image of the acquired read image data, wherein the hardware processor controls the conveyance speed based on speed control information for controlling a driving speed of a driver of the transferer and/or the fixer, the speed control information being stored in a storage in advance, and as the speed control information, information for controlling the driving speed of the driver is set according to a conveyance position on the paper sheet with respect to the transferer and/or the fixer.

2. The image forming apparatus according to claim 1, wherein the hardware processor analyzes an image defect and/or paper sheet damage, as analysis of an image.

3. The image forming apparatus according to claim 2, wherein the image defect includes at least one of image rubbing, transfer misalignment, color shift, expansion or contraction of an image, gloss unevenness, and image contamination, and the paper sheet damage includes at least one of a wrinkle of the paper sheet, waviness of the paper sheet, a scratch of the paper sheet, and fold of the paper sheet.

4. The image forming apparatus according to claim 2, wherein the hardware processor analyzes the image defect and the paper sheet damage by comparison with an image pattern stored in advance.

5. The image forming apparatus according to claim 2, wherein the hardware processor changes the speed control information based on presence or absence of occurrence of the image defect and/or the paper sheet damage or an abnormality occurring position on the paper sheet.

6. The image forming apparatus according to claim 1, wherein the speed control information is set as a speed control table in which a speed control value of the driver for each conveyance position on the paper sheet with respect to the transferer and/or the fixer is set.

7. The image forming apparatus according to claim 1, wherein the read image acquisitor acquires a paper sheet physical property measured by a medium detection apparatus, and the hardware processor controls the driver of the transferer and/or the fixer by using the speed control information corresponding to the paper sheet physical property, the speed control information being stored in the storage.

8. The image forming apparatus according to claim 1, wherein, in a paper sheet passing mode in which an image is formed on both surfaces of the paper sheet, the hardware processor controls the driver of the transferer and/or the fixer by using the speed control information corresponding to each of front and back surfaces of the paper sheet, the speed control information being stored in the storage.

9. The image forming apparatus according to claim 1, wherein the hardware processor controls a relative speed between the transferer and the fixer by using the speed control information.

10. The image forming apparatus according to claim 1, wherein the hardware processor set a speed of the transferer to be constant and controls a speed of the fixer by using the speed control information.

11. The image forming apparatus according to claim 6, wherein the hardware processor determines the speed control information by using a learning model generated by machine learning based on the conveyance position on the paper sheet with respect to the transferer and/or the fixer, the speed control value of the driver for each conveyance position, and an analysis result of the image of the read image data.

12. The image forming apparatus according to claim 11, wherein the machine learning is further performed based on information regarding the paper sheet physical property.

13. The image forming apparatus according to claim 12, wherein the physical property includes at least one of rigidity, a water content, and a grain direction of the paper sheet.

14. The image forming apparatus according to claim 11, wherein at a time of the machine learning of the learning model, an image defect and paper sheet damage are analyzed as analysis of an image, the image is evaluated as abnormal when the occurrence of the image defect or the paper sheet damage is detected, the image is evaluated as normal when the occurrence of the image defect or the paper sheet damage is not detected, a positive reward is provided when the evaluation result is normal, and a negative reward is provided when the evaluation result is abnormal.

15. The image forming apparatus according to claim 11, wherein a loop detection sensor that detects a loop of the paper sheet is further provided on a conveyance path between the transferer and the fixer, and the machine learning is further performed based on an output of the loop detection sensor.

16. An image forming system comprising:

the image forming apparatus according to claim 1; and a reader that reads an image on a paper sheet on which an image is formed by the image forming apparatus on a downstream side of the image forming apparatus in a conveyance direction.

17. A non-transitory recording medium storing a computer readable control program for controlling a conveyance speed of a paper sheet in a transferer and/or a fixer in an image forming apparatus including the transferer that transfers a toner image on an image carrier formed by an image former onto the paper sheet and the fixer that heats and thereby fixes the toner image on the paper sheet, the control program causing a computer to execute:

acquiring read image data of the paper sheet on a downstream side of the fixer in a conveyance direction, the read image data being generated by a reader that reads an image of the paper sheet; and changing or updating the conveyance speed based on an image of the read image data acquired in the acquiring, wherein the conveyance speed is controlled based on speed control information for controlling a driving speed of a driver of the transferer and/or the fixer, and as the speed control information, information for controlling the driving speed of the driver is set according to a conveyance position on the paper sheet with respect to the transferer and/or the fixer.

18. The non-transitory recording medium storing a computer readable control program according to claim 17, wherein the speed control information is set as a speed control table in which a speed control value of the driver for each conveyance position on the paper sheet with respect to the transferer and/or the fixer is set.

19. The non-transitory recording medium storing a computer readable control program according to claim 18, wherein in the changing or updating, the speed control information is determined by using a learning model generated by machine learning based on the conveyance position on the paper sheet with respect to the transferer and/or the fixer, the speed control value of the driver for each conveyance position, and an analysis result of the image of the read image data.

* * * * *